US008290379B2

(12) United States Patent
Nakajima et al.

(10) Patent No.: US 8,290,379 B2
(45) Date of Patent: Oct. 16, 2012

(54) IMAGE FORMING DEVICE AND DETACHABLE PROCESS UNIT

(75) Inventors: Keigo Nakajima, Nagoya (JP); Shunsuke Ishii, Toki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 332 days.

(21) Appl. No.: 12/749,767

(22) Filed: Mar. 30, 2010

(65) Prior Publication Data

US 2010/0303477 A1 Dec. 2, 2010

(30) Foreign Application Priority Data

May 29, 2009 (JP) ..... 2009-130903

(51) Int. Cl.
*G03G 15/00* (2006.01)

(52) U.S. Cl. ..... 399/13

(58) Field of Classification Search ..... 399/13, 399/113

See application file for complete search history.

(56) References Cited

U.S. PATENT DOCUMENTS

| | | | | |
|---|---|---|---|---|
| 7,190,921 | B2 | 3/2007 | Ishii et al. | |
| 7,242,874 | B2 | 7/2007 | Tsusaka | |
| 2005/0053394 | A1 | 3/2005 | Ishii et al. | |
| 2005/0220461 | A1 | 10/2005 | Tsusaka | |
| 2005/0265736 | A1 | 12/2005 | Seto et al. | |
| 2007/0058993 | A1 | 3/2007 | Horinoe | |
| 2010/0080610 | A1 * | 4/2010 | Yoshizumi | 399/111 |

FOREIGN PATENT DOCUMENTS

| | | | |
|---|---|---|---|
| JP | 4-157477 | A | 5/1992 |
| JP | 6167845 | A | 6/1994 |
| JP | 9050224 | A | 2/1997 |
| JP | 2001013852 | A | 1/2001 |
| JP | 2005-049524 | | 2/2005 |
| JP | 2005049525 | A | 2/2005 |
| JP | 2005292357 | A | 10/2005 |
| JP | 2005-338354 | | 12/2005 |
| JP | 2005345587 | A | 12/2005 |
| JP | 2005345939 | A | 12/2005 |
| JP | 2007-079121 | | 3/2007 |
| JP | 2008233210 | A | 10/2008 |

OTHER PUBLICATIONS

Decision to Grant for Japanese patent application No. 2009-130904 mailed Aug. 9, 2011.

Office action for Japanese patent application No. 2009-130903 dated Mar. 8, 2011.

* cited by examiner

*Primary Examiner* — Quana M Grainger
(74) *Attorney, Agent, or Firm* — Banner & Witcoff, Ltd.

(57) ABSTRACT

An image forming device includes a main casing, a cartridge accommodating portion, a detection unit and a determination unit. The cartridge accommodating portion is configured to detachably accommodate a first cartridge and a second cartridge that is able to be detachably combined with the first cartridge, the first cartridge being provided with a pressing member movable between a first position and a second position, the pressing member being in the first position when the second cartridge is removed from the first cartridge, the pressing member being in the second position when the second cartridge is combined with the first cartridge. The detection unit is provided on the main casing and is configured to perform non-contact position detection of the pressing member. The determination unit is configured not to start image forming operations until the detection unit detects that the pressing member is in the second position.

23 Claims, 15 Drawing Sheets

IMAGE FORMING DEVICE AND DETACHABLE PROCESS UNIT

CROSS REFERENCE TO RELATED APPLICATION

This application claims priority from Japanese Patent Application No. 2009-130903 filed May 29, 2009. The entire content of the priority application is incorporated herein by reference.

TECHNICAL FIELD

The present invention relates to an image forming device and a drum cartridge that is detachably loadable in the image forming device, and also to a pressing member provided on the drum cartridge.

BACKGROUND

A conventional image forming device includes a main casing within which a process unit is detachably accommodated. In such an image forming device, the process unit is configured of a drum cartridge and a developing cartridge. The drum cartridge is detachably loadable in the main casing and includes a photosensitive drum. The developing cartridge is formed with a toner chamber for accommodating toner therein and is detachably mounted on the drum cartridge. In other words, the process unit can be separated into the drum cartridge and the developing cartridge, and the process unit as a whole is detachably loadable in the main casing of the image forming device.

The developing cartridge includes a developing roller for supplying the accommodated toner to the photosensitive drum. The drum cartridge has a drum frame on which a lever is provided as a pressing member so that the developing roller can be pressed against the photosensitive drum.

SUMMARY

In the above-described image forming device, when the process unit is unloaded from the main casing for a maintenance purpose, the process unit is separated into the drum cartridge and the developing cartridge. At this time, a careless user may bring the process unit back to the main casing in an incomplete state, i.e., only either one of the drum cartridge and the developing cartridge may possibly be brought back to the main casing.

Further, in case of replacing the developing cartridge with a new one in the process unit, the drum cartridge, which should not be replaced, may be thrown away together with the old developing cartridge. If this is the case, a new developing cartridge alone may be loaded in the main casing without the necessary drum cartridge.

In either case, the conventional image forming device cannot detect that the loaded process unit is incomplete since the developing cartridge is detachably mountable in the main casing via the drum cartridge. In other words, the above-described image forming device can hardly, if not impossible, distinguish a state where the drum cartridge alone is mounted in the main casing from a state where the drum cartridge is mounted in the main casing with the developing cartridge mounted on the drum cartridge.

As a result, the image forming device is allowed to start image forming operations, although a paper jam will result, even though either one of the drum cartridge and developing cartridge has not been loaded. Occurrence of the paper jam makes the user realize at that time that there is something wrong with the loaded process unit, i.e., either only one of the drum cartridge and the developing cartridge has been loaded in the main casing. However, desirably, occurrence of such error should be prevented as early as possible before a paper jam actually happens.

In view of the foregoing, it is an object of the present invention to provide an image forming device, a drum cartridge and a pressing member that would not allow image formation to be started until a complete process unit is detected to have been loaded in the image forming device.

In order to attain the above and other objects, there is provided an image forming device including a main casing, a cartridge accommodating portion, a detection unit and a determination unit. The cartridge accommodating portion is configured to detachably accommodate a first cartridge and a second cartridge that is able to be detachably combined with the first cartridge, the first cartridge being provided with a pressing member movable between a first position and a second position, the pressing member being in the first position when the second cartridge is removed from the first cartridge, the pressing member being in the second position when the second cartridge is combined with the first cartridge. The detection unit is provided on the main casing and is configured to perform non-contact position detection of the pressing member. The determination unit is configured not to start image forming operations until the detection unit detects that the pressing member is in the second position.

According to another aspect of the present invention, there is provided a drum cartridge that is detachably loadable in an image forming device. The drum cartridge includes a photosensitive drum on which an electrostatic latent image is formable, a casing, a pressing member and a light path forming member. The casing rotatably supports the photosensitive drum, the casing detachably accommodating a developing cartridge including a developing roller, the developing roller supplying developer to the photosensitive drum when the developing cartridge is mounted on the casing. The pressing member is provided on the casing, the pressing member being movable between a first position and a second position, the pressing member being in the first position when the developing cartridge is removed from the casing, the pressing member being in the second position when the developing cartridge is mounted on the casing, the pressing member pressing the developing roller against the photosensitive drum in the second position. The light path forming member includes an incident surface, an output surface and a guide member, the guide member directing light incident on the incident surface toward the output surface, the output surface outputting the light coming from the incident surface to outside of the casing when the pressing member is in the second position.

According to still another aspect of the present invention, there is provided a drum cartridge that is detachably loadable in an image forming device. The drum cartridge includes a photosensitive drum on which an electrostatic latent image is formable, a casing and a pressing member. The casing rotatably supports the photosensitive drum, the casing detachably accommodating a developing cartridge including a developing roller, the developing roller supplying developer to the photosensitive drum when the developing cartridge is mounted on the casing. The pressing member is provided on the casing, the pressing member being movable between a first position and a second position, the pressing member being in the first position when the developing cartridge is removed from the casing, the pressing member being in the second position when the developing cartridge is mounted on the casing, the pressing member pressing the developing roller against the photosensitive drum in the second position, the pressing member including a light blocking portion that blocks light when the pressing member is in the second position.

According to further aspect of the present invention, there is provided a pressing member that is movably supported to a drum cartridge including a photosensitive drum. The drum cartridge is capable of detachably accommodating therein a developing cartridge including a developing roller. The pressing member presses the developing roller against the photosensitive drum, the pressing member including a light path forming member including an incident surface, an output surface and a guide member, the guide member directing light incident on the incident surface toward the output surface, the output surface outputting the light coming from the incident surface to outside of the drum cartridge when the developing cartridge is mounted on the drum cartridge.

DETAILED DESCRIPTION

Figure 1:
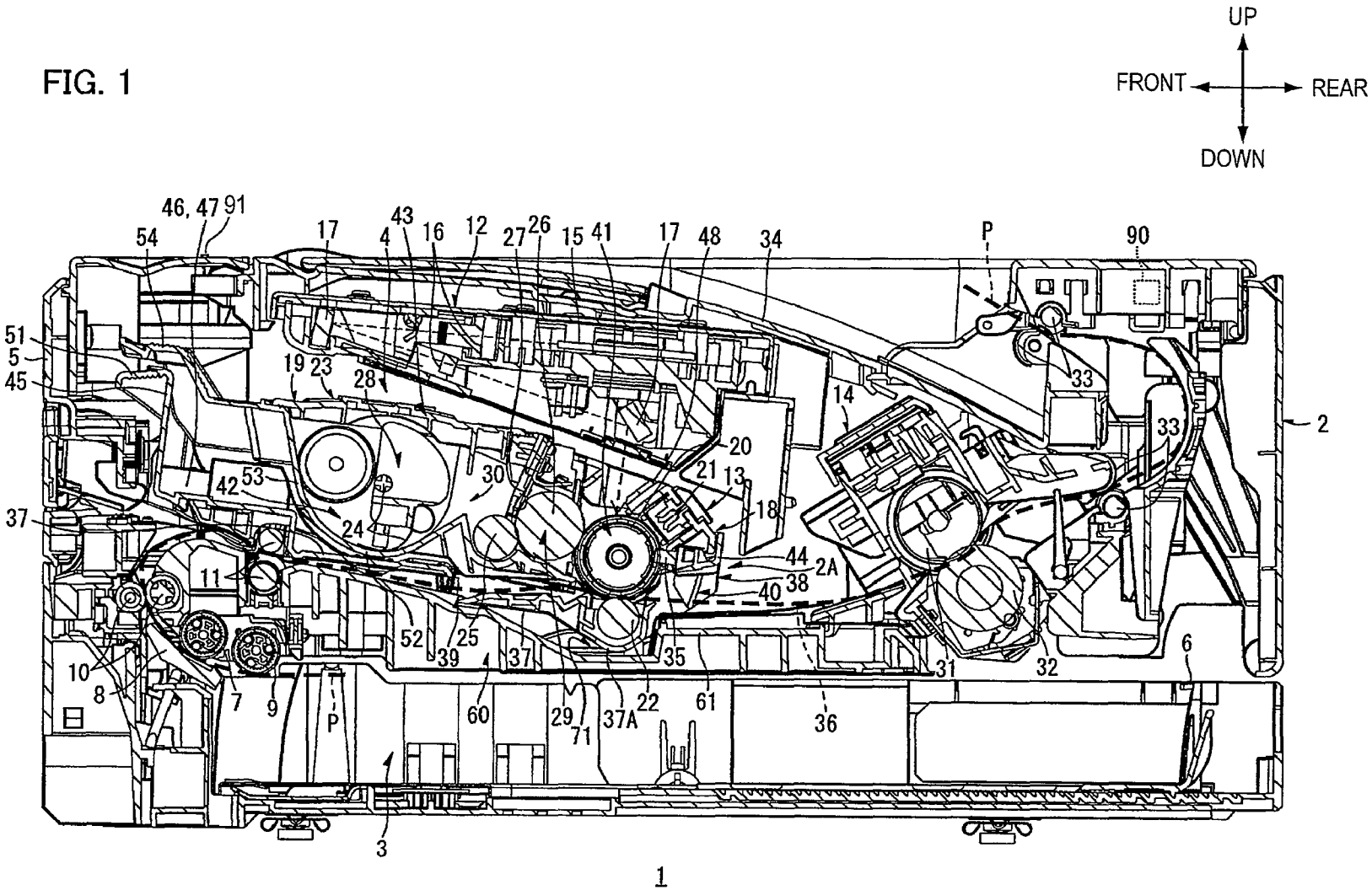
FIG. 1 is a cross-sectional view of a printer which is common to all embodiments of the present invention in a front-to-rear direction, the printer including a main casing in which a drum cartridge and a developing cartridge are detachably loaded.

First, a printer 1 according to a first embodiment of the present invention will be described first with reference to FIGS. 1 through 6. In the following description, the left side of the printer 1 in FIG. 1 will be referred to as the "front side," while the right side of the printer 1 will be referred to as the "rear side." Further, the right side of the printer 1 when view from the front side (the near side in FIG. 1) will be defined as the "right side," while the left side of the printer 1 when viewed from the front side (the far side in FIG. 1) will be defined as the "left side." The left-to-right direction may also be referred to as the "width direction." Also, each direction in a drum cartridge 18 and a developing cartridge 19 (described later) will be defined assuming that both cartridges 18 and 19 are disposed in an orientation in which they are loaded in the printer 1.

First of all, a general configuration of the printer 1 according to the first embodiment will be described with reference to FIG. 1. The printer 1 has a main casing 2 within which a feeder section 3 and an image forming section 4 are provided. A CPU 90 is also disposed within the main casing 2.

The main casing 2 has a front wall on which a front cover 5 is pivotably movably supported. The front cover 5 opens or closes an internal space 2A which is a space within the main casing 2. The main casing 2 has an upper surface on which a sheet discharge tray 34 is formed.

The feeder section 3 includes a sheet tray 6, a feeding roller 7, a feeding pad 8, a pick-up roller 9, a pair of conveyor rollers 10 and a pair of registration rollers 11. The sheet tray 6 accommodates therein sheets P in a stacked state. The pick-up roller 9 picks up a sheet P located uppermost in the sheet tray 6 and conveys the same toward a position between the feeding roller 7 and the feeding pad 8. The sheet P passes between the feeding roller 7 and the feeding pad 8, then between the pair of conveyor rollers 10, and is subsequently conveyed toward the pair of registration rollers 11. The registration rollers 11 convey the sheet P toward a transfer position (to be described later) of the image forming section 4.

The image forming section 4 includes a scanner unit 12, a process unit 13 and a fixing unit 14.

The scanner unit 12 is disposed at a position uppermost within the main casing 2. The scanner unit 12 includes a laser source (not shown), a polygon mirror 15, a plurality of lenses 16 and a plurality of reflection mirrors 17. As shown by a broken arrow in FIG. 1, the scanner unit 12 emits a laser beam toward a photosensitive drum 20 (described later) of the process unit 13.

The process unit 13 is disposed below the scanner unit 12. The process unit 13 is detachably loadable in the main casing 2 (the internal space 2A) when the front cover 5 is opened. The process unit 13 includes the drum cartridge 18 and the developing cartridge 19 that is detachably mountable on the drum cartridge 18. The drum cartridge 18 and the developing cartridge 19 are, therefore, detachably loadable in the main casing 2 as an integral unit (i.e., as the process unit 13).

The drum cartridge 18 includes a photosensitive drum 20, a Scorotron charger 21, a transfer roller 22 and a cleaning member 35. The photosensitive drum 20 is rotatably supported to the drum cartridge 18. The charger 21, the transfer roller 22 and the cleaning member 35 are disposed so as to surround the photosensitive drum 20.

The developing cartridge 19 has a developing cartridge casing 23 within which an agitator 24, a supply roller 25, a developing roller 26 and a thickness-regulating blade 27 are arranged. The developing cartridge casing 23 is divided into a toner accommodation chamber 28 and a developing chamber 29. The toner accommodation chamber 28 is disposed forward of the developing chamber 29 in the front-to-rear direction. The toner accommodation chamber 28 and the developing chamber 29 are in communication with each other through a communication hole 30. The toner accommodation chamber 28 accommodates non-magnetic monocomponent toner.

The agitator 24 is rotatably disposed within the toner accommodation chamber 28. The supply roller 25 is rotatably provided within the developing chamber 29 at a position rearward of the communication hole 30. The developing roller 26 is rotatably provided within the developing chamber 29 and is pressed against the supply roller 25 at a position rearward of the supply roller 25. The thickness-regulating blade 27 is formed in a plate shape extending in the left-to-right direction. The thickness-regulating blade 27 has a base end fixed to the developing cartridge casing 23, and a free end that is in pressure contact with the developing roller 26.

The toner within the toner accommodation chamber 28 is agitated by the agitator 24, and is supplied to the supply roller 25 within the developing chamber 29 via the communication hole 30. As the supply roller 25 rotates, the toner is then supplied to the developing roller 26. At this time, the toner is positively tribocharged between the supply roller 25 and the developing roller 26 to which a developing bias is applied. In accordance with the rotation of the developing roller 26, the toner carried thereon is maintained as a thin layer of uniform thickness by the thickness-regulating blade 27.

The photosensitive drum 20 has a surface which is charged by the charger 21 as the photosensitive drum 20 rotates. The scanner unit 12 selectively irradiates a laser beam on the surface of the photosensitive drum 20, forming an electrostatic latent image thereon based on image data.

When the photosensitive drum 20 rotates and opposes the developing roller 26, the electrostatic latent image formed on the photosensitive drum 20 is supplied with the positively charged toner borne on the surface of the developing roller 26, thereby forming a visible toner image on the surface of the photosensitive drum 20. The toner image is transferred onto the sheet P when the sheet P is conveyed to a position between the photosensitive drum 20 and the transfer roller 22. This point is called a transfer position.

Toner left on the surface of the photosensitive drum 20 after the toner image has been transferred is collected by the developing roller 26. The cleaning member 35 removes, from the sheet P, paper dusts deposited on the surface of the photosensitive drum 20.

The fixing unit 14 is disposed rearward of the process unit 13. The fixing unit 14 includes a heat roller 31 and a pressure roller 32. The pressure roller 32 is disposed in opposition to the heat roller from below. The toner image transferred on the sheet P is thermally fixed thereon while the sheet P passes between the heat roller 31 and the pressure roller 32. The sheet P, on which the toner image is fixed, is then conveyed toward a plurality of discharge rollers 33, which is disposed in the vicinity of the sheet discharge tray 34 within the main casing 2, and is finally discharged onto the sheet discharge tray 34.

As described above, while being conveyed within the main casing 2, the sheet P follows a conveying path 36 which is indicated as a solid broken line in FIG. 1. The conveying path 36 has an inverted S shape when seen in the left-to-right direction.

Next, detailed configurations of the drum cartridge 18 and the developing cartridge 19 according to the first embodiment will be described with reference to FIGS. 2 through 4B.

The drum cartridge 18 has a drum casing 38 within which the photosensitive drum 20, the charger 21, the transfer roller 22 and the cleaning member 35 are disposed. The drum casing 38 has a hollow box shape, being elongated in the left-to-right direction and being flat in the up-to-down direction, as shown in FIGS. 1 and 2.

Figure 2:
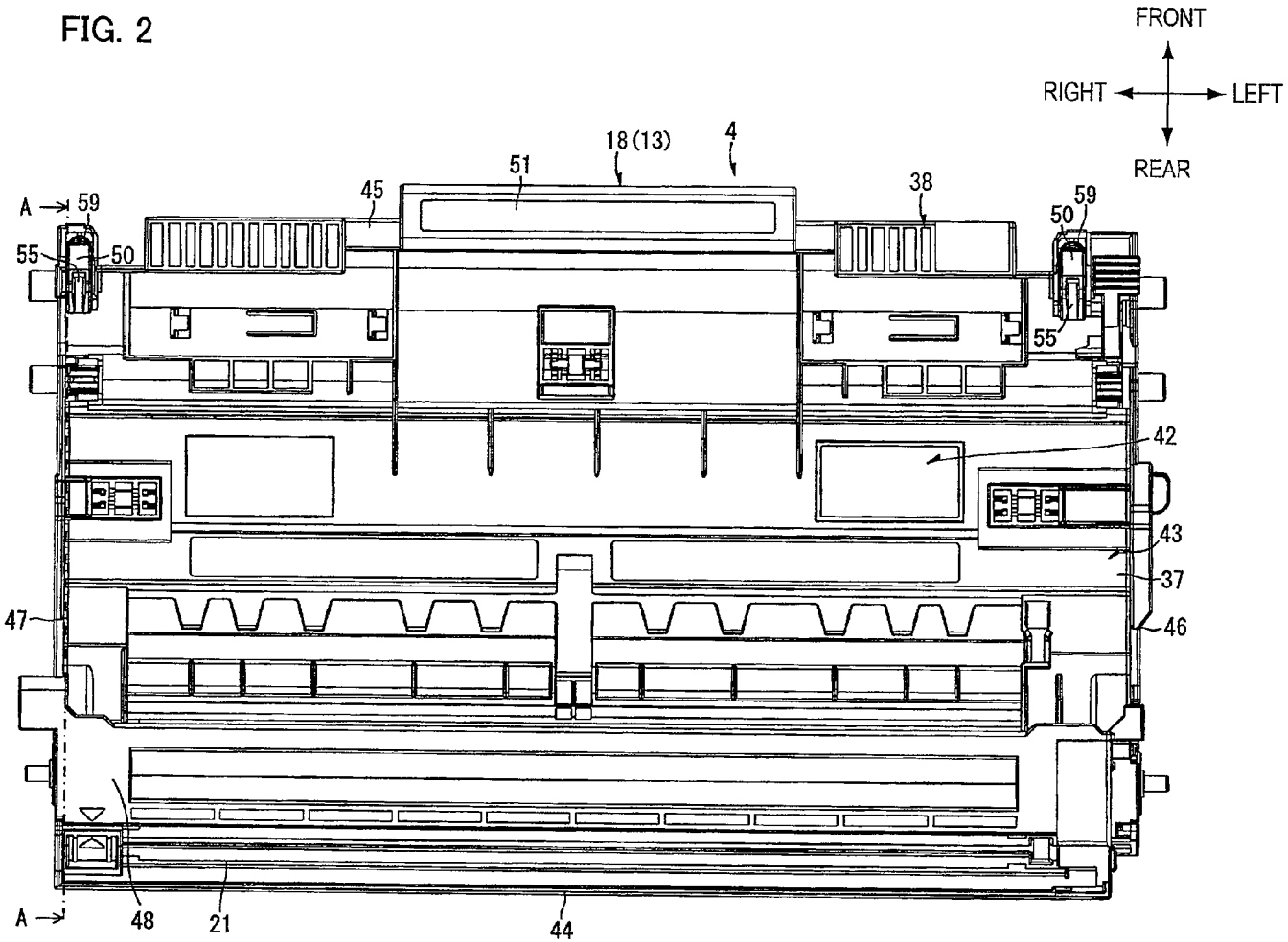
FIG. 2 is a plane view of a drum cartridge according to a first embodiment of the present invention, the drum cartridge including a pressing member.
Figure 4A:
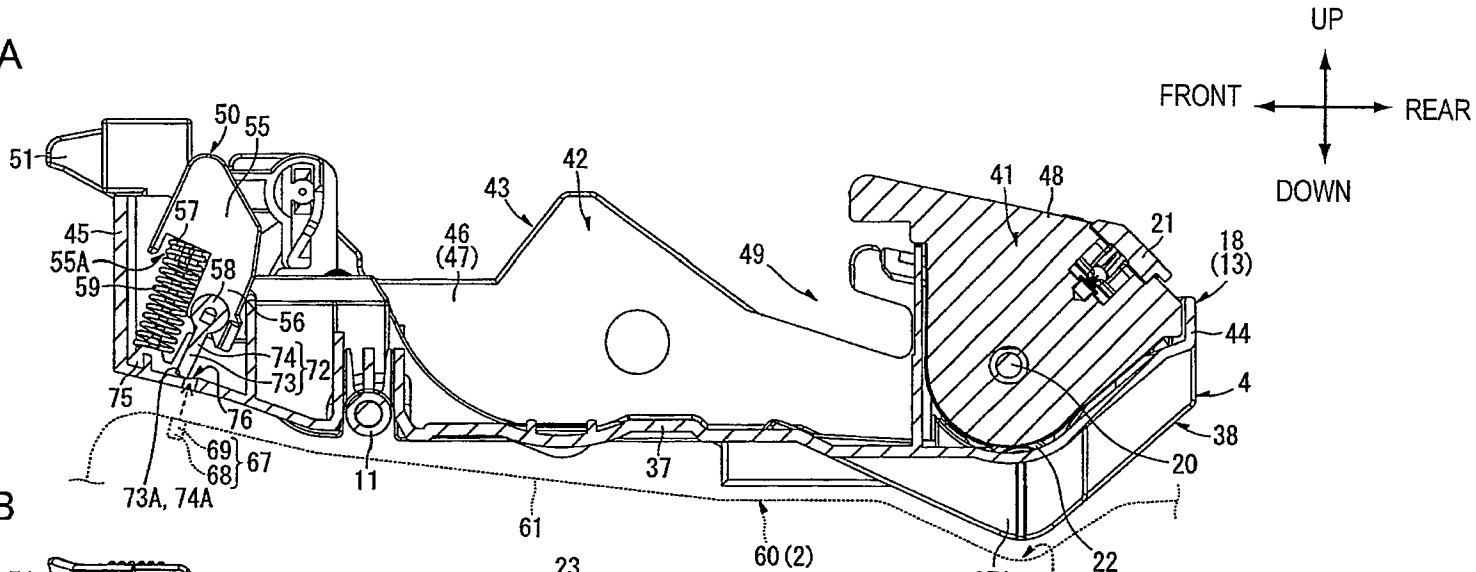
FIG. 4A is a cross-sectional view of the drum cartridge according to the first embodiment taken along a chain line A-A shown in FIG. 2, in which the developing cartridge is removed from the drum cartridge and the pressing member is in a first position.

As shown in FIGS. 1, 2 and 4A, the drum casing 38 includes a ceiling wall 48, a bottom wall 37, a front wall 45, a rear wall 44, a left wall 46 and a right wall 47, all of which defining an interior of the drum casing 38. An inlet 39 is formed on the bottom wall 37 at a position substantially center thereof in the front-to-rear direction, while an outlet 40 is formed on the rear wall 44. The inlet 39 and the outlet 40 are in connection with the interior of the drum casing 38 (see FIG. 1). The inlet 39 and the outlet 40 have a width greater than that of the sheet P. As described, the sheet P conveyed from the registration rollers 11 enters the interior of the drum casing 38 via the inlet 39, passes the transfer position and goes out of the drum casing 38 through the outlet 40 toward the fixing unit 14. In other words, the inlet 39 and the outlet 40 partially constitute the conveying path 36.

A portion of the bottom wall 37 forward of the inlet 39 constitutes a part of the conveying path 36, and rotatably supports one of the pair of registration rollers 11 that is located upward of the other in the up-to-right direction.

The interior of the drum casing 38 is divided into a drum accommodation chamber 41 and a cartridge accommodation chamber 42, as shown in FIGS. 1, 2 and 4A. The drum accommodation chamber 41 is located rearward of the cartridge accommodation chamber 42 in the front-to-rear direction. The drum accommodation chamber 41 and the cartridge accommodation chamber 42 are in communication with each other.

The drum accommodation chamber 41 is a space bounded by the rear wall 44 and respective rear portions of the ceiling wall 48, the bottom wall 37, the left wall 46 and the right wall 47, the rear portion being a portion rearward of the cartridge accommodation chamber 42. The photosensitive drum 20, the charger 21, the transfer roller 22 and the cleaning member 35 are disposed within this drum accommodation chamber 41.

The photosensitive drum 20 is formed in a circular cylindrical shape and has a rotational shaft extending in the width direction. The rotational shaft has widthwise ends which are rotatably supported to the left wall 46 and the right wall 47 of the drum casing 38 respectively. When installed on the drum casing 38, the surface of the photosensitive drum 20 is partially exposed from the drum accommodation chamber 41 toward the cartridge accommodation chamber 42 (i.e., forward).

Figure 4B:
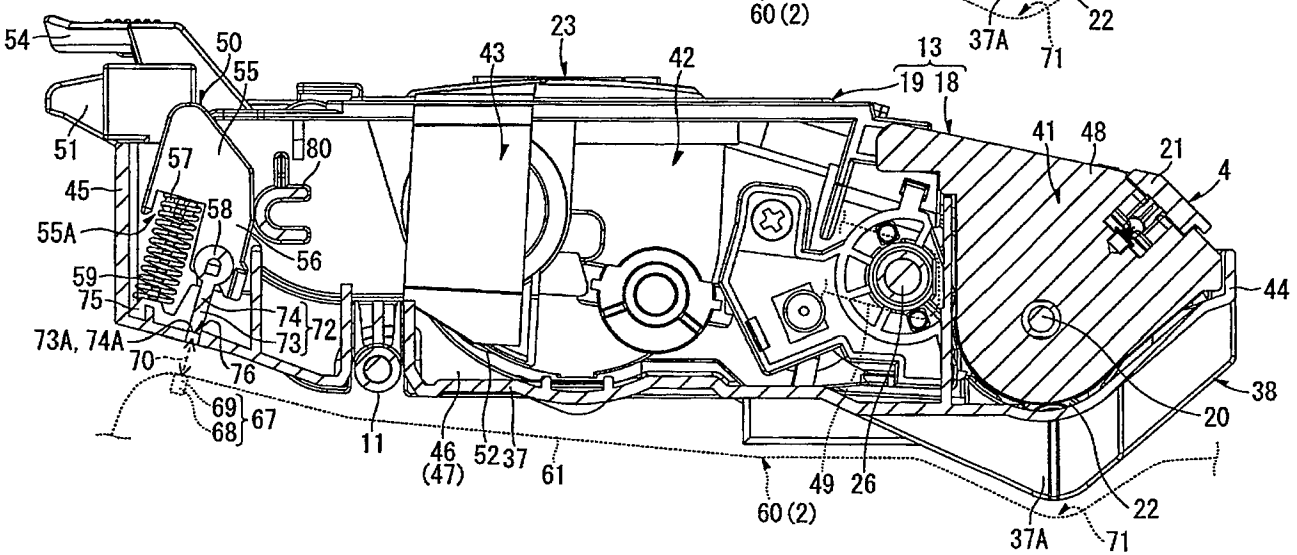
FIG. 4B is a cross-sectional view of the drum cartridge according to the first embodiment taken along a chain line A-A shown in FIG. 2, in which the developing cartridge is mounted on the drum cartridge and the pressing member is in a second position.

Each of the left wall 46 and the right wall 47 is formed with a guide section 49 that penetrates therethrough in the width direction, as shown in FIGS. 4A and 4B. Each guide section 49 originates from a position substantially center of an upper peripheral end of each wall in the front-to-rear direction, extending diagonally downward and rearward toward a position forward of the photosensitive drum 20. This position at which the guide section 49 ends will be referred to as the "rear end" thereof hereinafter.

The transfer roller 22 is disposed below the photosensitive drum 20 and is pressed against the photosensitive drum 20 from below. The transfer roller 22 has a rotational shaft extending in the widthwise direction whose widthwise ends are rotatably supported to the left wall 46 and the right wall 47 of the drum casing 38 respectively. The bottom wall 37 is formed with a protruding portion 37A that protrudes downward. The protruding portion 37A is positioned below the transfer roller 22 and spans the width of the drum casing 38. Following a circumferential surface of the transfer roller 22, the protruding portion 37A has an arcuate shape when viewed in the front-to-rear direction, as shown in FIGS. 1, 4A and 4B.

The cleaning member 35 is disposed on the rear wall 44 at a position rearward of the photosensitive drum 20 so as to be in contact with the same. The rear wall 44 has an upper end to which the charger 21 is supported such that the charger 21 is arranged to oppose the surface of the photosensitive drum 20, with a distance kept therebetween, at a position diagonally upward and rearward of the photosensitive drum 20.

The cartridge accommodation chamber 42 is a space bounded by the front wall 45 and respective forward portions of the ceiling wall 48, the bottom wall 37, the left wall 46 and the right wall 47, the forward portion being a portion forward of the drum accommodation chamber 41. A portion of the ceiling wall 48 corresponding to the cartridge accommodation chamber 42 is cut off, serving as an opening 43. In other words, the cartridge accommodation chamber 42 can be seen from above through the opening 43. The developing cartridge 19 is detachably mountable on the drum cartridge 18 through the opening 43. When mounted on the drum cartridge 18, the developing cartridge 19 is accommodated within the cartridge accommodation chamber 42 of the drum casing 38.

The front wall 45 has an upper end on which a grip 51 is integrally formed, as shown in FIGS. 2, 4A and 4B. The grip 51 extends forward from the upper end of the front wall 45. When the drum cartridge 18 is detachably loaded in the main casing 2, a user can hold the grip 51.

On the front wall 45 of the drum casing 38, a pair of pressing members 50 is provided as shown in FIG. 2 for pressing the developing cartridge 19 rearward against the photosensitive drum 20 when the developing cartridge 19 is mounted on the drum cartridge 18. The pressing members 50 are disposed at positions corresponding to widthwise ends of the front wall 45 respectively within the cartridge accommodation chamber 42. That is, two pressing members 50 are arranged in the width direction with a distance kept therebetween at front end portion of the cartridge accommodation chamber 42.

Figure 3A:
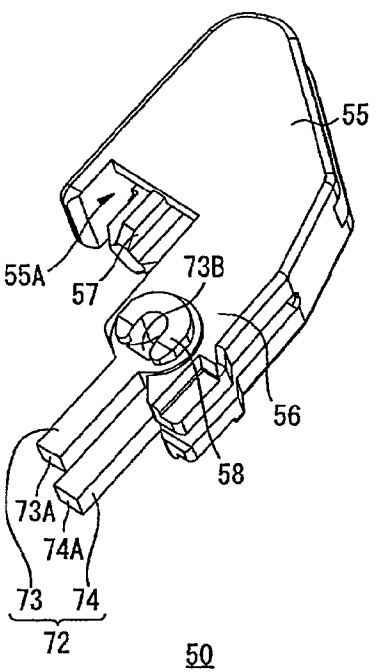
FIG. 3A is a perspective view of the pressing member according to the first embodiment.
Figure 3B:
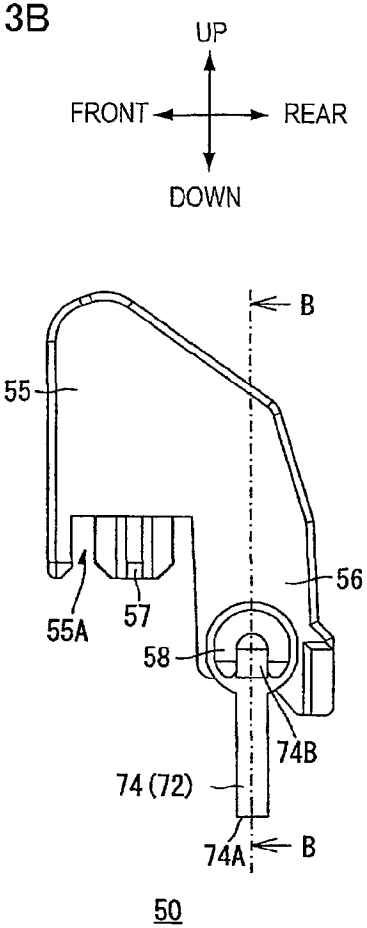
FIG. 3B is a right side view of the pressing member according to the first embodiment.

As shown in FIG. 3B, the pressing member 50 is formed as a block having a substantially upside-down J shape when viewed in the widthwise direction. More specifically, the pressing member 50 integrally includes a pressing section 55 and an extending section 56. In the following description, the pressing member 50 will be described assuming that the pressing member 50 is in a position shown in FIG. 3B.

The pressing section 55 has a substantially triangular shape when seen in the widthwise direction, as shown in FIG. 3B. The pressing section 55 has an upper end whose corner is rounded off, a front end and a rear end. The pressing section 55 has a rear periphery that first extends from the upper end diagonally downward and rearward and then bends and extends in a substantially vertical direction to the rear end. The pressing section 55 has a front periphery that connects between the front end and the upper end and extends in a substantially vertical direction.

The extending section 56 extends downward from the rear end of the pressing section 55 in a linear manner. The extending section 56 has a dimension in the vertical direction (longitudinal direction) nearly identical to, or about twice as long as that of the pressing section 55.

The pressing section 55 has a bottom surface on which a recess 55A is formed at a position forward of the extending section 56, as shown in FIGS. 3A and 3B. Within the recess 55A, a boss 57 protruding downward is formed. The boss 57 is integrally formed with the pressing section 55.

Figure 3C:
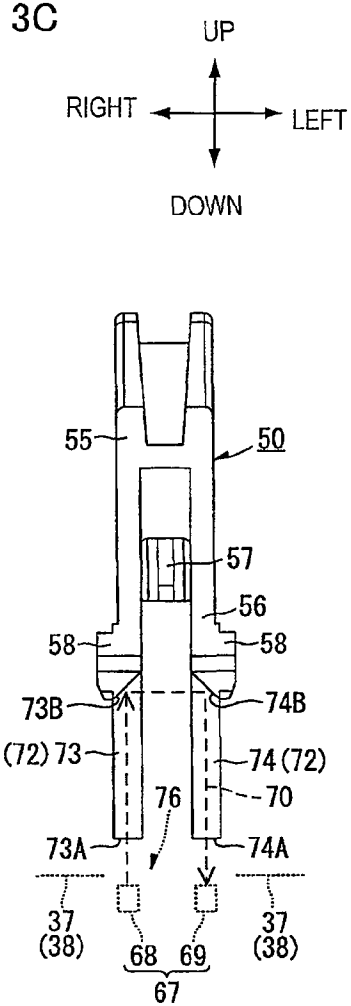
FIG. 3C is a cross-sectional view of the pressing member according to the first embodiment taken along a chain line B-B shown in FIG. 3B.

The extending section 56 has an upper half portion and a lower half portion. The lower half portion is divided into an incoming section 73 and an outgoing section 74. The incoming section 73 and the outgoing section 74 are disposed in opposition to each other in the width direction and extend in the up-to-down direction in parallel to each other, as shown in FIG. 3C. In the present embodiment, the outgoing section 74 is located leftward of the incoming section 73 in the width direction. Each of the incoming section 73 and the outgoing section 74 has a width (in the front-to-rear direction) narrower than that of the upper half portion of the extending section 56, but has a longitudinal length (in the up-to-down direction) substantially the same as each other.

The incoming section 73 has a bottom end surface 73A and an upper end surface 73B. The bottom end surface 73A is a flat surface extending in the horizontal direction, while the upper end surface 73B is a sloped surface extending diagonally upward and leftward, as shown in FIG. 3C. Likewise, the outgoing section 74 has a bottom end surface 74A and an upper end surface 74B. The bottom end surface 74A is flat in the horizontal direction, while the upper end surface 74B slopes diagonally downward and leftward. The bottom end surface 73A and the bottom end surface 74A are arranged in separation from each other in the width direction. The upper end surface 73B and the upper end surface 74B are in opposition to and in separation from each other in the width direction. The upper end surface 73B and the upper end surface 74B respectively serve to guide the light, as will be described later.

The incoming section 73 and the outgoing section 74 are formed of a transparent material (glass or resin, for example) in the present embodiment. Alternatively, the pressing member 50 as a whole may be made of a transparent material. The upper end surface 73B and the upper end surface 74B are formed of a material that reflects light, or alternatively, may be painted with a color that reflects light (white, for example). In case that the upper end surface 73B and the upper end surface 74B do not have light reflective characteristics, portions of the lower half portion of the extending section 56 connected to the upper end surface 73B and the upper end surface 74B may be formed so as to reflect light.

The upper half portion of the extending section 56 is formed with two protrusions 58 for pivotably movably supporting the pressing member 50, as shown in FIG. 3C. More specifically, the upper half portion of the extending section 56 has a right side surface that is connected to the incoming section 73 and a left side surface that is connected to the outgoing section 74. The right side surface and the left side surface are respectively formed with one protrusion 58 at a position substantially center of the extending section 56 in the up-to-down direction (i.e., above the incoming section 73 and the outgoing section 74). In other words, two protrusions 58 formed on the pressing member 50 are aligned and in opposition to each other in the width direction and are pivotably movably supported to supporting members (not shown) of the drum casing 38 respectively. In this way, the two protrusions 58 aligned in the width direction serve like an axis about which the pressing member 50 pivotally moves. For the sake of simplicity, hereinafter, the two protrusions 58 formed in each pressing member 50 are collectively referred to as the "axis 58" of the pressing member 50.

Each of the left wall 46 and the right wall 47 has a front end portion to which one of the pressing members 50 is supported such that each pressing member 50 can pivotally move about the axis 58, as shown in FIG. 4A. Two bosses 75 protruding upward and rearward are formed on the bottom wall 37, one at a position where the front wall 45 and the left wall 46 are connected (on the left) and the other at a position where the front wall 45 and the right wall 47 are connected (on the right) in the width direction.

Each boss 57 of the pressing members 50 is arranged at a position diagonally rearward and upward of the corresponding boss 75, which is provided on either side of the bottom wall 37 in the width direction, so as to oppose the same at a distance. A coil spring 59 is provided between the boss 57 and the boss 75 in opposition thereto, as shown in FIG. 4A. Due to the biasing force of the coil spring 59, the coil springs 59 bias the pressing sections 55 of the pressing members 50 diagonally upward and rearward via the boss 57, thereby urging the entire pressing member 50 diagonally upward and rearward. When the developing cartridge 19 is removed from the drum cartridge 18, the pressing member 50 is urged to be in a position shown in FIG. 4A, which is called as a "first position."

When the pressing member 50 is in the first position, the bottom end surface 73A and the bottom end surface 74A of the extending section 56 oppose the bottom wall 37 of the drum casing 38 from above with a small space interposed therebetween. Hereinafter, the bottom end surface 73A and the bottom end surface 74A are collectively called as the "bottom end" of the extending section 56 whenever necessary. The bottom wall 37 is formed with two through-holes 76 at positions in coincidence with the bottom ends of the extending sections 56 and areas adjacent thereto in the up-to-down direction. When each pressing member 50 is in the first position, the bottom end of the extending section 56 is located at a position deviated forward from the corresponding through-hole 76, as shown in FIG. 4A. Therefore, neither of the bottom end surface 73A and the bottom end surface 74A is visible from the corresponding through-hole 76.

When the developing cartridge 19 is mounted on the drum cartridge 18, on the other hand, the pressing member 50 is made to pivotally move, from the first position, by a prescribed amount in a counterclockwise direction as shown in FIG. 4B. This position of the pressing member 50 shown in FIG. 4B is called as a "second position". In other words, the pressing member 50 is capable of moving between the first position and the second position due to the pivotal movement thereof. Details of the second position will be described later.

The developing cartridge casing 23 of the developing cartridge 19 has a hollow box shape, being elongated in the width direction and flat in the up-to-down direction. The developing cartridge casing 23 has a size just right for being accommodated within the cartridge accommodation chamber 42 of the drum casing 38 (see FIGS. 1 and 4B).

The developing cartridge casing 23 has left and right side walls whose front ends are respectively formed with a pressed member 80. The pressed member 80 is a boss protruding outward in the width direction. The pressed member 80 has a substantially C shape when viewed in the width direction, as shown in FIG. 4B.

As described before, the toner accommodation chamber 28 is positioned forward of the developing chamber 29 within the developing cartridge casing 23. The toner accommodation chamber 28 is formed in a substantially circular shape when viewed in the width direction, following the trajectory of the rotation of the agitator 24, as shown in FIG. 1. The developing cartridge casing 23 has a bottom surface 52 a portion of which corresponding to the toner accommodation chamber 28 protrudes downward and has an arcuate shape when viewed in the front-to-rear direction.

The bottom surface 52 has a front end extending upward, which constitutes a front wall 53 in the developing cartridge casing 23. The front wall 53 has an upper end on which a grip 54 is integrally formed. The grip 54 extends forward and upward from the upper end of the front wall 53. The user may hold the grip 54 when detachably mounting the developing cartridge 19 on the drum cartridge 18, or when detachably loading the process unit 13 in the main casing 2.

Each of the agitator 24, the supply roller 25 and the developing roller 26 disposed within the developing cartridge casing 23 has a rotational shaft extending in the width direction. The rotational shaft of the developing roller 26 has widthwise ends protruding outward from the developing cartridge casing 23 in the width direction (refer to FIG. 4B).

Figure 6:
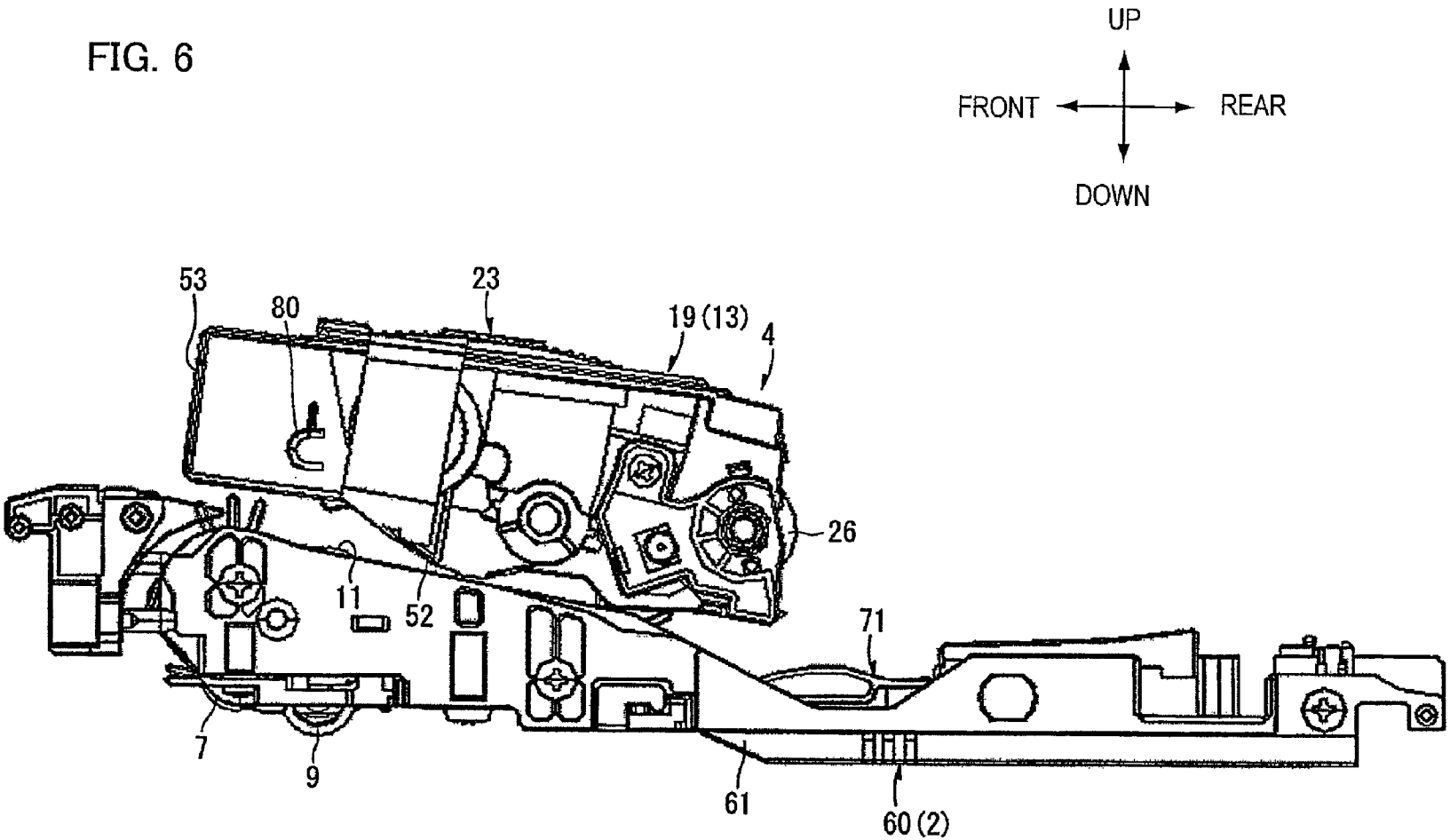
FIG. 6 is a right side view of essential portions of the developing cartridge and the feed unit, in which the developing cartridge alone is loaded in the main casing.

The developing roller 26 has a circumferential surface that is exposed rearward from the developing cartridge casing 23 (see FIG. 6). When the developing cartridge 19 is mounted on the drum cartridge 18 and accommodated within the cartridge accommodation chamber 42, the exposed circumferential surface of the developing roller 26 is in contact with the circumferential surface of the photosensitive drum 20 which is exposed forward (toward the cartridge accommodation chamber 42) from the drum accommodation chamber 41. In this way, the toner borne on the surface of the developing roller 26 is supplied to the electrostatic latent image formed on the surface of the photosensitive drum 20.

Next, how the developing cartridge 19 is detachably mounted on the drum cartridge 18 will be described with reference to FIGS. 4A and 4B.

The developing cartridge 19 is mounted on the drum cartridge 18 (more precisely, on the drum casing 38) outside of the main casing 2. The user holds the grip 54 of the developing cartridge 19 and brings the developing cartridge 19 to a position upward and forward of the drum cartridge 18 in which the pressing member 50 is in the first position as shown in FIG. 4A. The user then moves the developing cartridge 19 downward and rearward, pushing the developing cartridge 19 into the cartridge accommodation chamber 42 through the opening 43 of the drum casing 38. At this time, the widthwise ends of the rotational shaft of the developing roller 26 are respectively engaged with the corresponding guide sections 49 of drum casing 38. While the widthwise ends of the rotational shaft of the developing roller 26 are being guided along the guide section 49, the developing cartridge 19 moves downward and rearward and is accommodated within the cartridge accommodation chamber 42.

While the developing cartridge 19 is accommodated within the cartridge accommodation chamber 42, the pressed members 80 of the developing cartridge 19 respectively contact with the rear peripheries of the pressing sections 55 of the pressing members 50. Specifically, the pressed member 80 contacts a portion of the rear periphery that extends downward and rearward. As a result, the pressing member 50 starts to pivotally move about the axis 58, against the biasing force of the coil spring 59, in the counterclockwise direction in FIG. 4A.

Subsequently, when the widthwise ends of the rotational shaft of the developing roller 26 reach the rear ends of the guide sections 49, the developing cartridge 19 stops moving along the guide sections 49, being completely accommodated within the cartridge accommodation chamber 42. At the same time, the pivotal movement of the pressing member 50 in the counterclockwise direction is also terminated and the pressing member 50 is in the second position as shown in FIG. 4B. In this way, the developing cartridge 19 is mounted on the drum cartridge 18, completing the process unit 13.

When the developing cartridge 19 is mounted on the drum cartridge 18, the developing cartridge 19 is placed on the bottom wall 37 of the drum casing 38 and the rotational shaft of the developing roller 26 is in engagement with the rear ends of the guide sections 49. The developing cartridge 19 is thus positioned relative to the drum cartridge 18 with respect to the up-to-down direction.

At this time, the pressing members 50 are in the second position as shown in FIG. 4B. The pressing member 50 in the second position is slanted in a direction diagonally upward and rearward as the pressing member 50 in the first position, but the pressing member 50 in the second position is inclined relative to the vertical direction at an angle smaller than that in the first position. Therefore, in the second position, while the pressing section 55 of the pressing member 50 is located at a position slightly forward of that in the first position, the bottom end of the extending section 56 is located at a position slightly rearward of that in the first position. The bottom end of the extending section 56 therefore faces the corresponding through-hole 76 of the bottom wall 37 from above. As a consequence, the bottom end surface 73A of the incoming section 73 and the bottom end surface 74A of the outgoing section 74 are made visible from the through-hole 76.

Even when the pressing member 50 is in the second position, the coil spring 59 still urges the pressing member 50. In other words, the pressing member 50 tries to move back to the first position, which means that the pressing section 55 is trying to move rearward. At this time, the pressed member 80 of the developing cartridge 19 is pushed rearward.

In this way, when the developing cartridge 19 is mounted on the drum cartridge 18, each pressing member 50 pushes the corresponding pressed member 80 of the developing cartridge 19 rearward, thereby biasing the developing cartridge 19 as a whole rearward. As a result, the developing roller 26 of the developing cartridge 19 can be in pressure contact with the photosensitive drum 20 of the drum cartridge 18 (see FIG. 1). In other words, each pressing member 50 serves to press the developing roller 26 toward the photosensitive drum 20 in the second position. The developing cartridge 19 is thus pressed rearward by the pressing member 50, while the developing roller 26 is pressed against the photosensitive drum 20. The developing cartridge 19 is in this way positioned relative to the drum cartridge 18 with respect to the front-to-rear direction.

On the other hand, when the developing cartridge 19 is removed from the drum cartridge 18, the user holds the grip 54 for pulling the developing cartridge 19 upward and forward. When the developing cartridge 19 as a whole has been pulled upward of the opening 43 of the drum casing 38, the developing cartridge 19 is completely separated from the drum cartridge 18. At this time, respective pressing member 50 moves back to the first position due to the biasing force of the coil spring 59.

Next, a feed unit 60 will be described with reference to FIG. 5.

The feed unit 60 constitutes a part of the feeder section 3. The feed unit 60 is disposed at a position between the sheet tray 6 and the process unit 13 in the up-to-down direction within the internal space 2A. The feed unit 60 includes a unit frame 61 to which the feeding roller 7, the pick-up roller 9, one of the conveyor rollers 10 located rearward of the other and one of the registration rollers 11 disposed downward of the other are rotatably supported (refer to FIG. 1).

Figure 5:
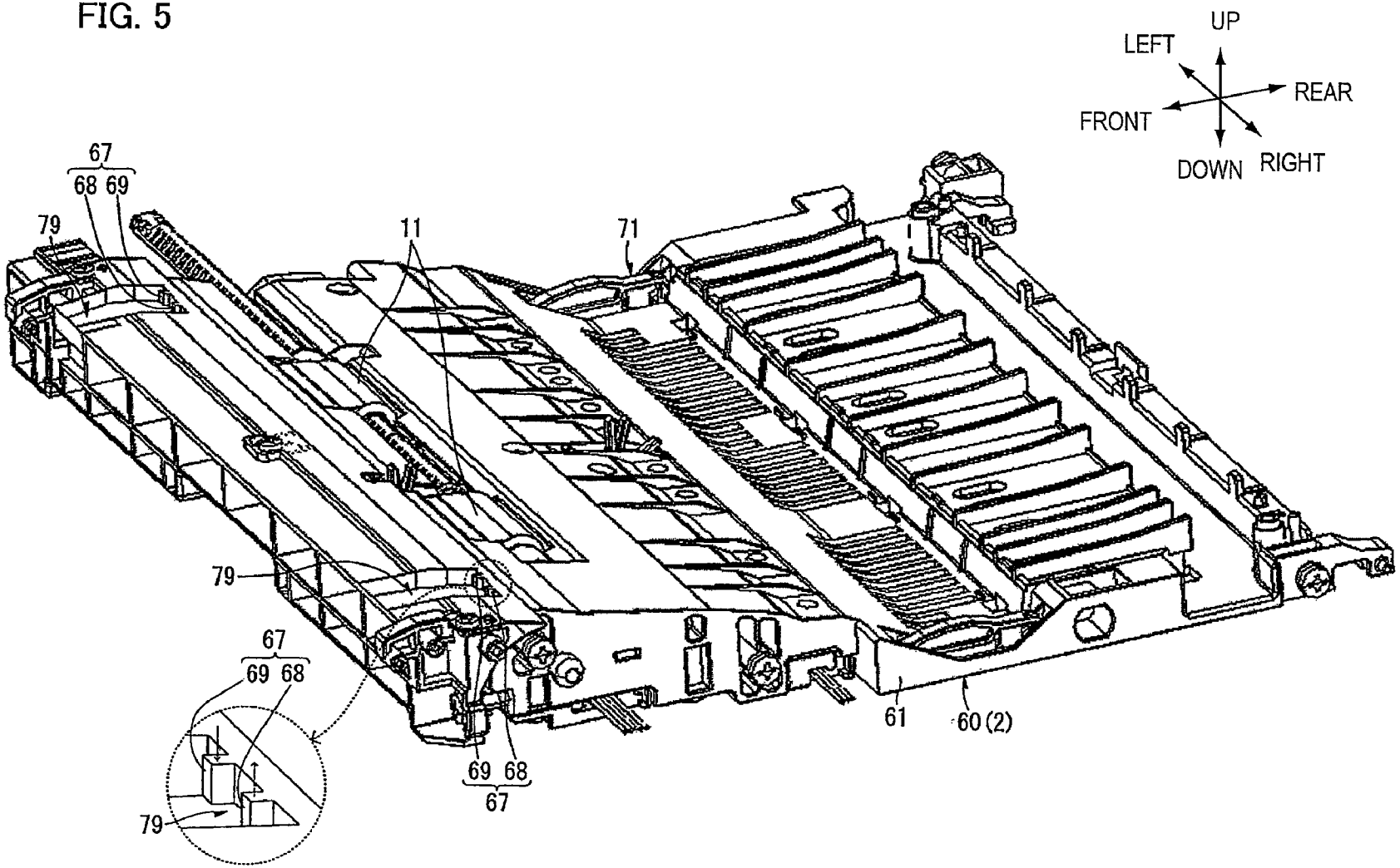
FIG. 5 is a perspective view of a feed unit provided within the main casing of the printer according to the first embodiment, the feed unit including a detection unit according to the first embodiment.

As shown in FIG. 5, the unit frame 61 has a hollow plate shape. The unit frame 61 has a substantially rectangular shape in a plan view, being flat in the up-to-down direction. More specifically, the unit frame 61 has a width slightly greater than that of the sheet P in the width direction and a length approximately two-thirds of that of the sheet tray 6 in the front-to-rear direction. The unit frame 61 has a front end portion which has a thickness in the up-to-down direction greater than that of a rear end potion thereof, although the unit frame 61 as a whole is formed to have a substantially uniform thickness across the front-to-rear direction. The front end portion of the unit frame 61 has an arcuate cross-section taken along a plane parallel to the front-to-rear direction.

The front end portion of the unit frame 61 has a bottom surface to which the feeding roller 7 and the pick-up roller 9 are supported, a front surface to which the rearward conveyor roller 10 is supported, and an upper surface to which the lower registration roller 11 is supported. The other conveyor roller 10 located forward and the feeding pad 8 are supported to the front wall of the main casing 2, while the other registration roller 11 located upward is supported to the drum cartridge 18 as described earlier.

The feed unit 60 is integrated with the main casing 2. A space between the feed unit 60 and the front wall of the main casing 2, and a space between the feed unit 60 and the process unit 13 constitute portions of the conveying path 36.

When loaded in the main casing 2, the process unit 13 is placed on the feed unit 60, thereby enabling the process unit 13 to be positioned within the main casing 2. More specifically, the unit frame 61 has an upper surface on which a recessed portion 71 is formed at a position substantially center of the upper surface in the front-to-rear direction. When the process unit 13 is loaded in the main casing 2, the protruding portion 37A of the bottom wall 37 of the drum casing 38 is coupled to the recessed portion 71 from above. In this way, the process unit 13 is positioned relative to the main casing 2 with the feed unit 60 (also refer to FIGS. 4A and 4B in which the upper rim of the feed unit 60 is shown as dotted lines).

The upper surface of the front end portion of the unit frame 61 is provided with two detection units 67 at positions coincident with the through-holes 76 formed on the bottom wall 37 of the drum cartridge 18, as shown in FIG. 5. The detection units 67 oppose the through-holes 76 respectively from below when the drum cartridge 18 is placed on the feed unit 60.

Each detection unit 67 includes a light emitting section 68 and a light receiving section 69. The light emitting section 68 and the light receiving section 69 are disposed in opposition to and in separation from each other in the width direction. Since aligned in the width direction, the light emitting section 68 and the light receiving section 69 appear as one component in FIGS. 4A and 4B. The light receiving section 69 is positioned leftward of the light emitting section 68 in the width direction, as shown in FIG. 5. The light emitting section 68 and the light receiving section 69 are both visible from the upper surface of the front end portion of the unit frame 61. The light emitting section 68 emits light toward the through-hole 76 (indicated by an upward broken arrow in an enclosed dotted circle shown in FIG. 5 and also by a broken arrow indicating upward in FIG. 4A), while the light receiving section 69 receives the light coming from the through-hole 76 (indicated by a downward broken arrow in the enclosed dotted circle in FIG. 5 and also by a dotted arrow indicating downward in FIG. 4B). The light emitting section 68 emits the light upward and the light receiving section 69 is configured to receive the light coming from above via the through-hole 76 when the pressing member 50 is in the second position, as will be described later.

The light emitting section 68 and the light receiving section 69 are arranged in separation from each other in the width direction. Therefore, the light emitted upward from the light emitting section 68 is never received at the light receiving section 69 without going to the through-hole 76. In other words, unless there is any member that directs the light emitted from the light emitting section 68 toward the light receiving section 69, the light emitted from the light emitting section 68 is never received at the light receiving section 69. The detection unit 67 detects the position of the pressing member 50 based on whether the light emitted from the light emitting section 68 is received at the light receiving section 69.

Next, how the process unit 13 (i.e., the drum cartridge 18 on which the developing cartridge 19 is mounted) is loaded in the main casing 2 (the internal space 2A) will be described with reference to FIGS. 3A through 6.

Before the process unit 13 is loaded in the main casing 2, the light emitting section 68 emits light continuously upward. At this time, the light emitted from the light emitting section 68 only goes upward, and is never received at the light receiving section 69. That is, a light path from the light emitting section 68 to the light receiving section 69 is not formed at this time.

When loading the process unit 13, the user first opens the front cover 5 for exposing the internal space 2A. Holding the grips 51 and 54, the user pushes the process unit 13 rearward into the internal space 2A. While pushing the process unit 13 rearward in the front-to-rear direction, the protruding portion 37A of the bottom wall 37 of the drum cartridge 18 is being coupled to the recessed portion 71 of the unit frame 61 from above. When the protruding portion 37A and the recessed portion 71 are coupled to each other, the process unit 13 stops moving further rearward. In this way, the process unit 13 is loaded in the main casing 2. When the process unit 13 has been loaded in the main casing 2, the user closes the front cover 5 for performing image formation.

When the process unit 13 has been thus loaded in the main casing 2, the bottom end surface 73A of the incoming section 73 and the bottom end surface 74A of the outgoing section 74 are both visible from the through-hole 76 since the pressing member 50 is in the second position. Hence, the bottom end surface 73A and the bottom end surface 74A are brought into opposition to the detection unit 67 from above. More specifically, as shown in FIG. 3C, the bottom end surface 73A opposes the light emitting section 68, while the bottom end surface 74A opposes the light receiving section 69.

Once the light emitted from the light emitting section 68 is incident on the bottom end surface 73A, the light proceeds upward within and along the incoming section 73. Here, since the bottom end surface 73A and the bottom end surface 74A are arranged in separation from each other in the width direction, the light from the light emitting section 68 is never incident on the bottom end surface 74A.

When the light moving upward within the incoming section 73 reaches the upper end surface 73B, the light is reflected by the upper end surface 73B, turns leftward, and proceeds further leftward in the width direction. The light thus exits from the incoming section 73 and then enters an upper portion of the outgoing section 74. The light further goes leftward and arrives at the upper end surface 74B, whereby the light is reflected and then heads downward within and along the outgoing section 74. When reaching the bottom end surface 74A, the light goes out of the bottom end surface 74A, proceeds downward, passes the through-hole 76 and is finally received at the light receiving section 69.

As described, when the process unit 13 (the pressing member 50 is in the second position) is loaded in the main casing 2, the light emitted from the light emitting section 68 travels until the light receiving section 69 via the incoming section 73 and the outgoing section 74. The path along which the light travels from the light emitting section 68 to the light receiving section 69 is called as a "light path 70" and is shown in FIGS. 3C and 4B. The incoming section 73 and the outgoing section 74 serve to form the light path 70, being collectively referred to as a "light path forming member 72" whenever necessary. The upper end surface 73B and the upper end surface 74B serve to direct the light incident on the bottom end surface 73A toward the bottom end surface 74A from which the light exits.

The detection unit 67 detects that the pressing member 50 is in the second position when the light emitted from the light emitting section 68 is received at the light receiving section 69 (i.e., when the light path 70 is formed).

When the detection unit 67 detects that the pressing member 50 is in the second position, the CPU 90 provided in the main casing 2 determines that the drum cartridge 18 on which the developing cartridge 19 is mounted (i.e., the completed process unit 13) has been loaded in the main casing 2.

On the other hand, when unloading the process unit 13 from the main casing 2, the user holds the grips 51 and 54 for pulling the process unit 13 forward. When getting out of the internal space 2A, the process unit 13 is completely separated from the main casing 2.

With the above-described configuration, the pressing member 50 provided on the drum cartridge 18 is configured to be movable between the first position in which the developing cartridge 19 has been removed from the drum cartridge 18, and the second position in which the developing cartridge 19 has been mounted on the drum cartridge 18. The pressing member 50 in the second position presses the developing roller 26 toward the photosensitive drum 20, thereby enabling the toner borne on the developing roller 26 to be smoothly supplied to the electrostatic latent image formed on the photosensitive drum 20.

Further, the detection unit 67 provided on the main casing 2 (the feed unit 60) detects the position of the pressing member 50 based on whether the light emitted from the light emitting section 68 is received at the light receiving section 69. With this configuration, the detection unit 67 can detect the position of the pressing member 50 without actually contacting the pressing member 50. Hence, comparing to a configuration in which the detection unit 67 and the pressing member 50 are in direct contact with each other, the detection unit 67 can more accurately detect the position of the pressing member 50 without suffering from disadvantageous effects due to errors that may be caused as a result of the contact. This configuration is also advantageous in that the detection unit 67 does not affect the pressing (biasing) performance of the pressing member 50.

In the present embodiment, the pressing member 50 is configured to make pivotal movements between the first position and the second position. An angle by which the pressing member 50 pivotally moves at this time is set to be about nine degrees, which is relatively small. However, since the detection unit 67 optically detects the position of the pressing member 50, the distinction between the first and second positions can be made with accuracy.

Further, the CPU 90 determines that the drum cartridge 18 with the developing cartridge 19 mounted thereon has been loaded in the main casing 2 when the detection unit 67 detects that the pressing member 50 is in the second position. This configuration allows the printer 1 to promptly determine whether the drum cartridge 18 is loaded in the main casing 2 in a state that the developing cartridge 19 has been mounted on the drum cartridge 18 at the time when the drum cartridge 18 is loaded in the main casing 2.

Further, when the developing cartridge 19 is separated from the drum cartridge 18, the pressing member 50 comes to the first position, instead of the second position, as shown in FIG. 4A. At this time, the bottom end surface 73A of the incoming section 73 and the bottom end surface 74A of the outgoing section 74 are not seen from below through the through-hole 76 but face the bottom wall 37 from above. Accordingly, the light path 70 is not formed and the light is not received by the light receiving section 69. The detection unit 67 thus detects that the pressing member 50 is in the first position (not in the second position) since the light receiving section 69 does not receive the light. Based on this detection result, the CPU 90 can determine that the loaded process unit 13 is incomplete (either one of the drum cartridge 18 and the developing cartridge 19 has not been loaded in the main casing 2).

Alternatively, suppose that the drum cartridge 18 is not loaded in the main casing 2 but the developing cartridge 19 alone is loaded in the main casing 2, as shown in FIG. 6. Since there is no pressing member 50 in this case, the light path 70 is not formed. The detection unit 67 thus detects that the light receiving section 69 does not receive the light, which indicates a situation the same as the state in which the pressing member 50 is in the first position. As a response, the CPU 90 can determine that the loaded process unit 13 is incomplete (either one of the drum cartridge 18 and the developing cartridge 19 has not been loaded in the main casing 2).

The main casing 2 is provided with an informing unit 91 for informing the user of various errors (see FIG. 1). When the CPU 90 detects an error (for example, either only one of the drum cartridge 18 and the developing cartridge 19 has been loaded in the main casing 2), the informing unit 91 informs the user about the occurrence of the error with a prescribed method before the image formation is performed (for example, when the front cover 5 is closed). Such a prescribed method may include a warning lamp, a warning sound or an error display. In this way, the informing unit 91 prompts the user to remove the error as early as possible once the error has occurred.

With the above-described configuration, occurrence of an abnormal loading status of the process unit 13 can be reliably detected as early as possible. In other words, if either only one of the developing cartridge 19 and the drum cartridge 18 is loaded in the main casing 2, the printer 1 of the present embodiment can detect such error at the time of occurrence, ensuring that the incomplete process unit 13 has never been loaded when image formation is started.

Further, since the light emitting section 68 emits light upward but the light receiving section 69 is disposed in separation from the light emitting section 68 in the width direction, the light emitted from the light emitting section 68 is never received at the light receiving section 69.

The detection unit 67 detects that the pressing member 50 is in the second position when the light receiving section 69 receives the light from the light emitting section 68 (See FIG. 4B). The pressing member 50 is provided with the light path forming member 72 which forms the light path 70 that directs the light coming from the light emitting section 68 to the light receiving section 69 when the pressing member 50 is in the second position. Such a simple configuration of the pressing member 50 ensures that the light receiving section 69 receives the light from the light emitting section 68 when the pressing member 50 is in the second position, thereby allowing the detection unit 67 to detect the position of the pressing member 50.

Further, since the light path forming member 72 is formed of a transparent material, the light path 70 can be formed easily. Also, the light path forming member 72 and the pressing member 50 are integrally formed as one member (see FIG. 3C), thereby enabling the detection unit 67 to reliably detect whether the pressing member 50 is in the second position. Integration of the light path forming member 72 with the pressing member 50 also leads to reduction of the number of parts.

The pressing member 50 is formed with the light path forming member 72 including the bottom end surface 73A on which the light emitted from the 68 is incident, and the bottom end surface 74A from which the light passing within the light path forming member 72 is outputted toward the light receiving section 69. The detection unit 67 (the light emitting section 68 and the light receiving section 69) is provided on the main casing 2. In other words, the position of the pressing member 50 can be detected at the main casing 2 side (to be precise, the CPU 90) depending on whether the light is received at the detection unit 67, thereby allowing the printer 1 to determine the status of the process unit 13 loaded in the main casing 2. As a result, the printer 1 can reliably detect that either only one of the developing cartridge 19 and the drum cartridge 18 has been loaded alone in the main casing 2.

Next, a second embodiment of the present invention will be described with reference to FIGS. 7A through 9F.

The second embodiment is different from the first embodiment in the configuration of the light path forming member 72. More specifically, in the light path forming member 72 of the second embodiment, the incoming section 73 and the outgoing section 74 are provided on the drum casing 38 of the drum casing 38, not on the pressing member 50. Hereinafter, like parts and components are designated by the same reference numerals to avoid duplicating description.

Figure 8A:
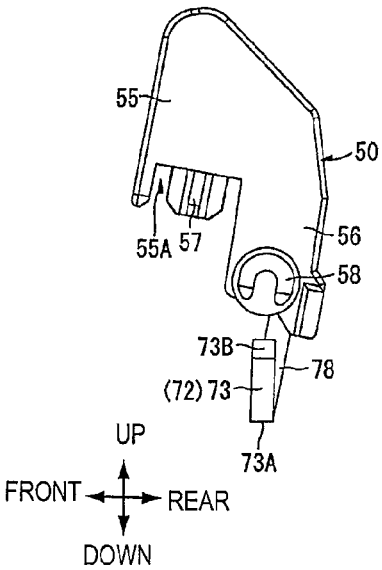
FIG. 8A is a right side view of the pressing member and a light path forming member according to the second embodiment, in which the pressing member is in the first position.
Figure 8B:
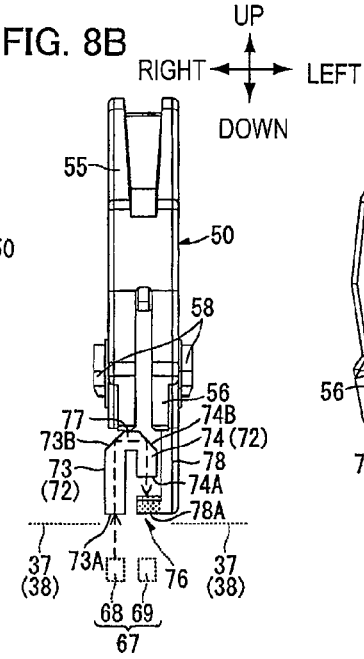
FIG. 8B is a rear view of the pressing member and the light path forming member shown in FIG. 8A.

As shown in FIG. 8B, the light path forming member 72 of the second embodiment has an inverted J shape when viewed from the rear. The incoming section 73 has the bottom end surface 73A that is configured to become visible from the through-hole 76. The incoming section 73 extends upward from the bottom end surface 73A and has a longitudinal length substantially twice as large as that of the outgoing section 74 in the up-to-down direction. The outgoing section 74 is disposed in opposition to and leftward of the incoming section 73 in the width direction. More precisely, the outgoing section 74 opposes an upper half portion of the incoming section 73. The outgoing section 74 has the bottom end surface 74A that opposes the through-hole 76 from above, but the bottom end surface 74A keeps a certain distance from the through-hole 76. The upper end surface 73B of the incoming section 73 and the upper end surface 74B of the outgoing section 74 are connected by a connection member 77 which is formed of a transparent material. In this way, the incoming section 73 and the outgoing section 74 are integrated via the connection member 77.

The pressing member 50 according to the second embodiment is formed with a light shielding section 78 instead of the light path forming member 72 of the first embodiment. More specifically, the light shielding section 78 is integrally formed with the left side surface of the upper half portion of the extending section 56. The left side surface of the upper half portion of the extending section 56 has a bottom end adjacent to and rearward of the axis 58, from which the light shielding section 78 extends downward in a linear manner as shown in FIGS. 8B, 8C and 8F. The light shielding section 78 is formed with a bottom end portion 78A which extends rightward from the light shielding section 78. The bottom end portion 78A is shown as a dotted area in FIGS. 7A, 7B, 8B through 8F, and 9A to 9F. The bottom end portion 78A and the light shielding section 78 are so formed as to be substantially perpendicular to each other. The light shielding section 78 has, when viewed from the rear, a substantially left-right reversed L shape, as shown in FIG. 8B. The light shielding section 78 (or at least the bottom end portion 78A) is formed of a material with light impermeable characteristic (such as a material of a nontransparent color).

The light shielding section 78 is arranged to come to a position leftward of the light path forming member 72 when seen from the rear. As the pressing member 50 pivotally moves about the axis 58 between the first position and the second position, the bottom end portion 78A moves between a position downward of and in opposition to the bottom end surface 74A, and a position deviated from the bottom end surface 74A in the front-to-rear direction so as not to oppose the same.

Figures 7A, 7B:
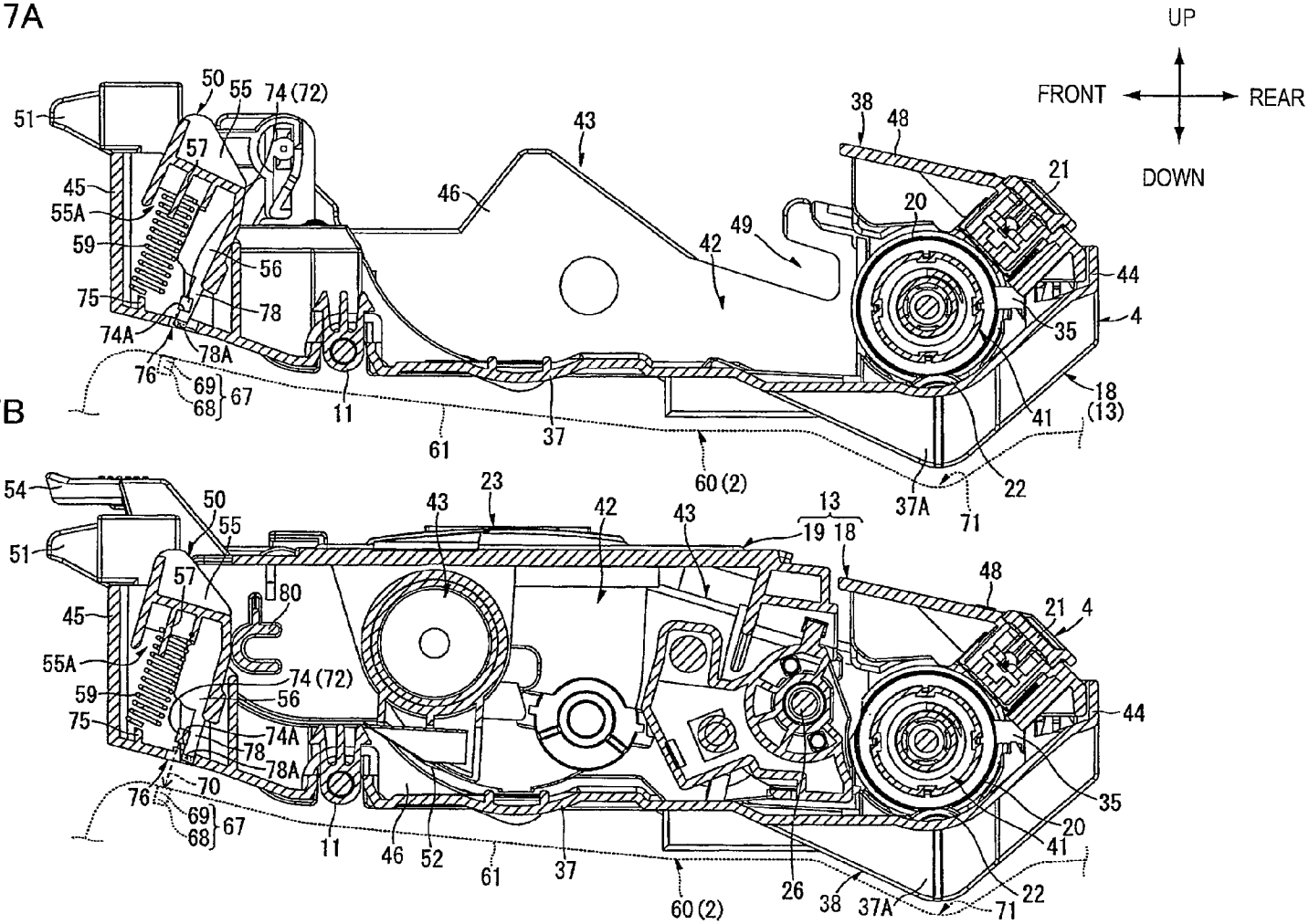
FIG. 7A is a cross-sectional view of a drum cartridge according to a second embodiment, in which the developing cartridge is removed from the drum cartridge, the drum including a pressing member according to the second embodiment, the pressing member being in the first position.
FIG. 7B is a cross-sectional view of the drum cartridge according to the second embodiment, in which the developing cartridge is mounted on the drum cartridge, the pressing member being in the second position.
Figure 8C:
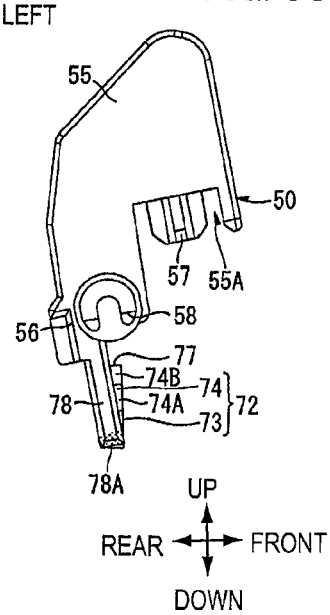
FIG. 8C is a left side view of the pressing member and the light path forming member shown in FIG. 8A.
Figure 8D:
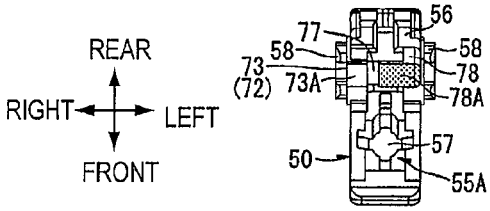
FIG. 8D is a bottom view of the pressing member and the light path forming member shown in FIG. 8A.
Figure 8E:
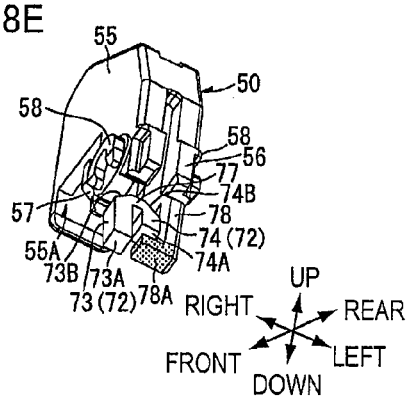
FIG. 8E is a perspective view of the pressing member and the light path forming member shown in FIG. 8A when viewed from below and rightward.
Figure 8F:
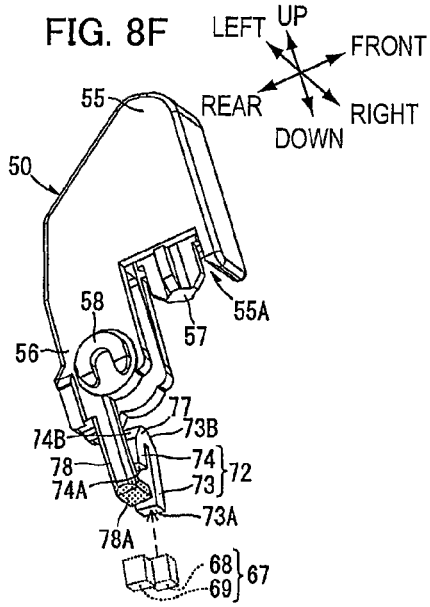
FIG. 8F is a perspective view of the pressing member and the light path forming member shown in FIG. 8A when viewed from below and leftward.

More specifically, when the pressing member 50 is in the first position as shown in FIGS. 7A and 8B, the bottom end portion 78A of the light shielding section 78 opposes the bottom end surface 74A of the outgoing section 74 from below. At this time, the bottom end surface 73A of the incoming section 73 is made visible from the through-hole 76, while the bottom end portion 78A of the light shielding section 78 is also visible from the through-hole 76. As described earlier, when the drum cartridge 18 is loaded in the main casing 2 without the developing cartridge 19, i.e., the pressing member 50 is in the first position, the detection unit 67 opposes the through-hole 76 from below. Therefore, the bottom end surface 73A opposes the light emitting section 68 from above, but the bottom end surface 74A does not oppose the light receiving section 69 because the bottom end portion 78A of the light shielding section 78 occupies a position between the bottom end surface 74A and the light receiving section 69 with respect to the up-to-down direction.

Therefore, although the light emitted from the light emitting section 68 is incident on the bottom end surface 73A of the incoming section 73 and goes along the light path forming member 72 via the upper end surface 73B, the connection member 77 and the upper end surface 74B, the light is not received by the light receiving section 69 since the light is blocked by the bottom end portion 78A, as shown by a broken arrow in FIG. 8B. In other words, when the pressing member 50 is in the first position, the light path 70 is not formed (also see FIG. 8F).

Figure 9A:
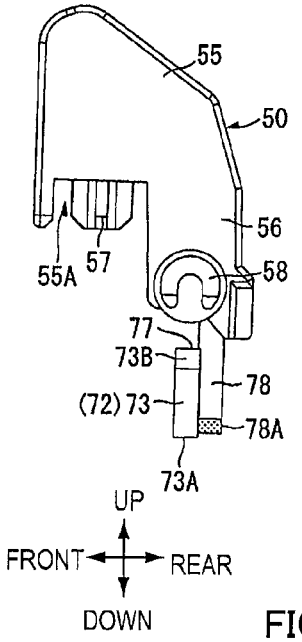
FIG. 9A is a right side view of the pressing member and the light path forming member according to the second embodiment, in which the pressing member is in the second position.
Figure 9B:
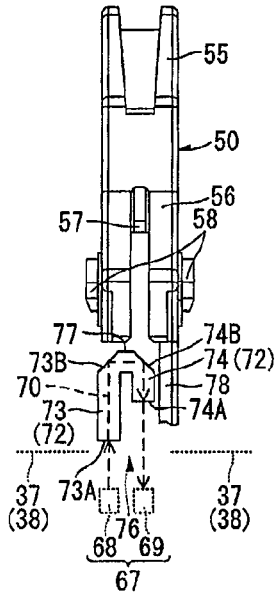
FIG. 9B is a rear view of the pressing member and the light path forming member shown in FIG. 9A.
Figure 9C:
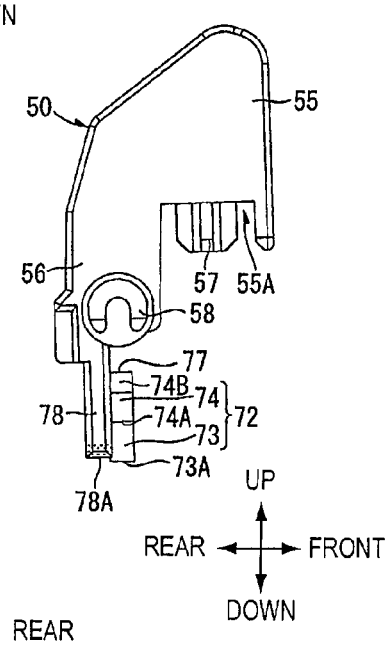
FIG. 9C is a left side view of the pressing member and the light path forming member shown in FIG. 9A.
Figure 9D:
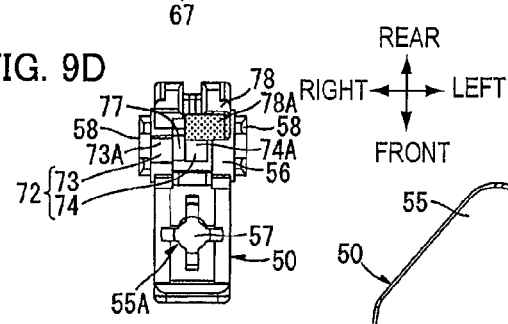
FIG. 9D is a bottom view of the pressing member and the light path forming member shown in FIG. 9A.
Figure 9E:
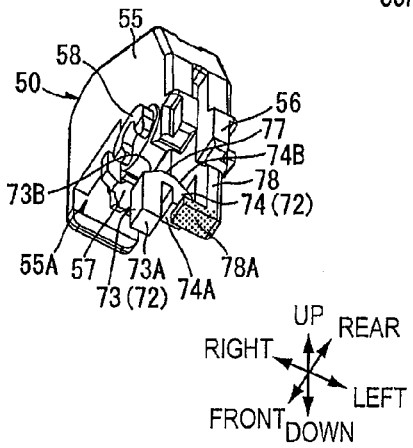
FIG. 9E is a perspective view of the pressing member and the light path forming member shown in FIG. 9A when viewed from below and rightward.
Figure 9F:
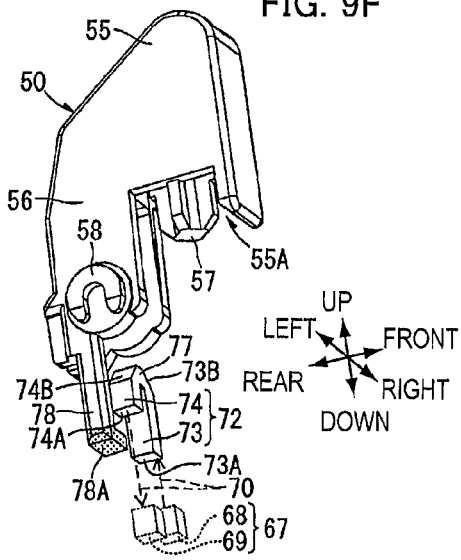
FIG. 9F is a perspective view of the pressing member and the light path forming member shown in FIG. 9A when viewed from below and leftward.

On the other hand, when the pressing member 50 is in the second position as shown in FIGS. 7B and 9B, the bottom end portion 78A of the light shielding section 78 is located at a position rearward of the bottom end surface 74A in the front-to-rear direction. Therefore, unlike in the first position, the bottom end portion 78A does not oppose the bottom end surface 74A from below (see FIGS. 9C though 9F). As a result, the bottom end surface 73A and the bottom end surface 74A are both made visible from the through-hole 76. Note that in FIG. 9B, the bottom end portion 78A of the light shielding section 78 is not shown as a matter of convenience.

When the pressing member 50 is in the second position, the process unit 13 is completed (the developing cartridge 19 is mounted on the drum cartridge 18) as shown in FIG. 7B. At this time, since the bottom end portion 78A is not interposed between the bottom end surface 74A and the light receiving section 69, the bottom end surface 73A of the incoming section 73 opposes the light emitting section 68 from above, and the bottom end portion 78A of the light shielding section 78 opposes the light receiving section 69 from above. Hence, the light emitted from the light emitting section 68 can be received by the light receiving section 69 without being blocked by the bottom end portion 78A after passing within and along the light path forming member 72, thereby forming the light path 70.

When the light path 70 is formed, the detection unit 67 detects that the pressing member 50 is in the second position, as in the first embodiment.

Next, a third embodiment of the present invention will be described with reference to FIGS. 10A through 12E.

The third embodiment is different from the first and second embodiments in the configuration of the light path forming member 72. More specifically, of the light path forming member 72, the incoming section 73 is provided on the drum casing 38 of the drum cartridge 18, while the outgoing section 74 is integrally formed with the pressing member 50.

Figure 11A:
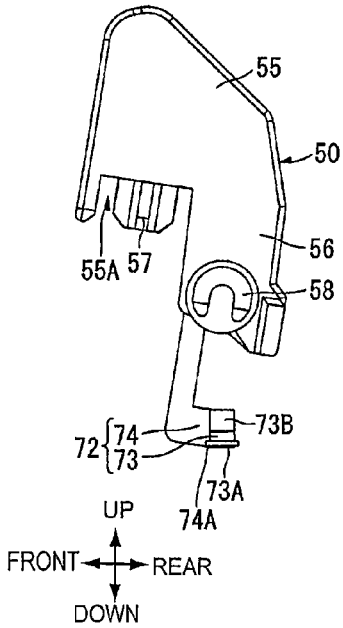
FIG. 11A is a right side view of the pressing member and a light path forming member according to the third embodiment, in which the pressing member is in the first position.
Figure 11B:
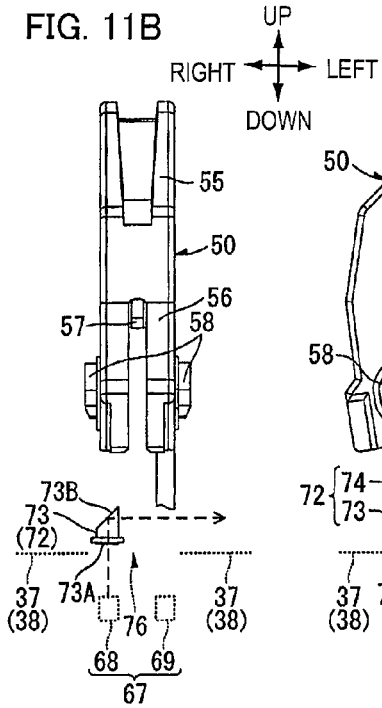
FIG. 11B is a rear view of the pressing member and the light path forming member shown in FIG. 11A.

The incoming section 73 is formed as a member different from the pressing member 50. As shown in FIG. 11B, the incoming section 73 is integrally formed with the drum casing 38 of the drum cartridge 18. The incoming section 73 has the bottom end surface 73A that opposes the through-hole 76 from above. The incoming section 73 extends upward from the bottom end surface 73A but has a relatively short length in the up-to-down direction.

Figure 11C:
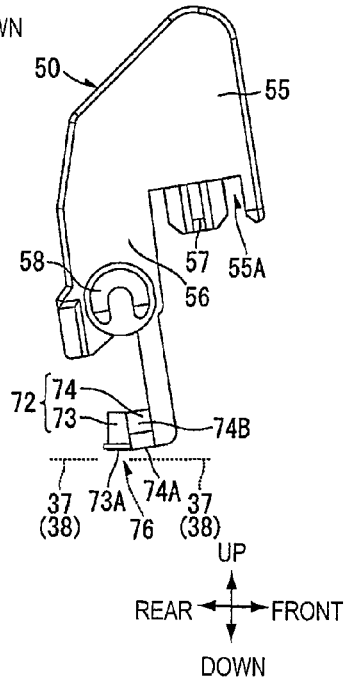
FIG. 11C is a left side view of the pressing member and the light path forming member shown in FIG. 11A.
Figure 11D:
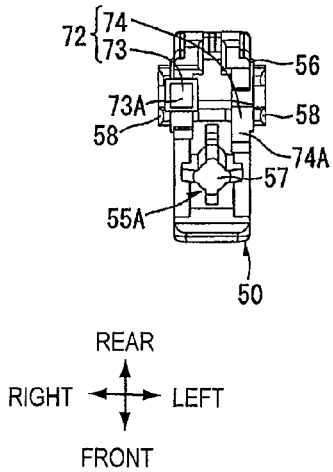
FIG. 11D is a bottom view of the pressing member and the light path forming member shown in FIG. 11A.
Figure 11E:
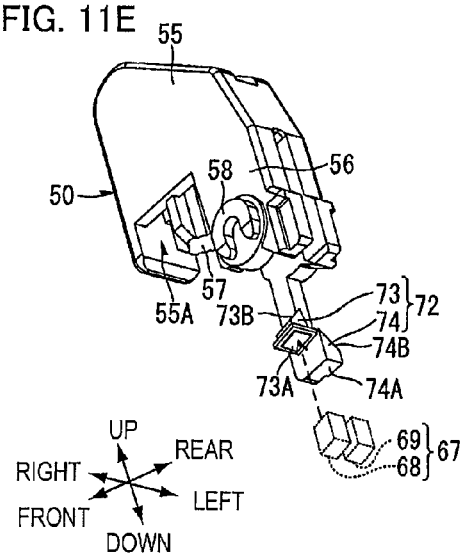
FIG. 11E is a perspective view of the pressing member and the light path forming member shown in FIG. 11A when viewed from below and rightward.

The outgoing section 74 of the third embodiment is integrally formed with the pressing member 50, as in the second embodiment, as shown in FIGS. 11C, 11E, 12C and 12E. The outgoing section 74 is arranged to come to a position in separation to and leftward of the incoming section 73 in the width direction, as shown in FIG. 11E. Specifically, the left side surface of the upper half portion of the extending section 56 has a bottom end adjacent to and forward of the protrusion 58 (serving as the axis 58) from which the outgoing section 74 extends downward in a linear manner. The outgoing section 74 is formed with a tip end portion that protrudes rearward. The tip end portion of the outgoing section 74 has the bottom end surface 74A that serves to direct light toward the light receiving section 69 and the upper end surface 74B that reflects light and direct the light toward the bottom end surface 74A.

In accordance with the pivotal movement of the pressing member 50 between the first position and the second position, the bottom end surface 74A is either made visible from the through-hole 76 (see FIGS. 12B and 12C) or in opposition to the bottom wall 37 of the drum casing 38 from above and is therefore not viewed from the through-hole 76 (see FIG. 11C).

More specifically, when the pressing member 50 is in the first position as shown in FIG. 11C, the outgoing section 74 is located at a position slightly forward of the incoming section 73, when viewed in the width direction, and is therefore not aligned with the incoming section 73 in the width direction. At this time, the bottom end surface 74A faces the bottom wall 37 and therefore cannot be seen from below through the through-hole 76.

Figure 10A:
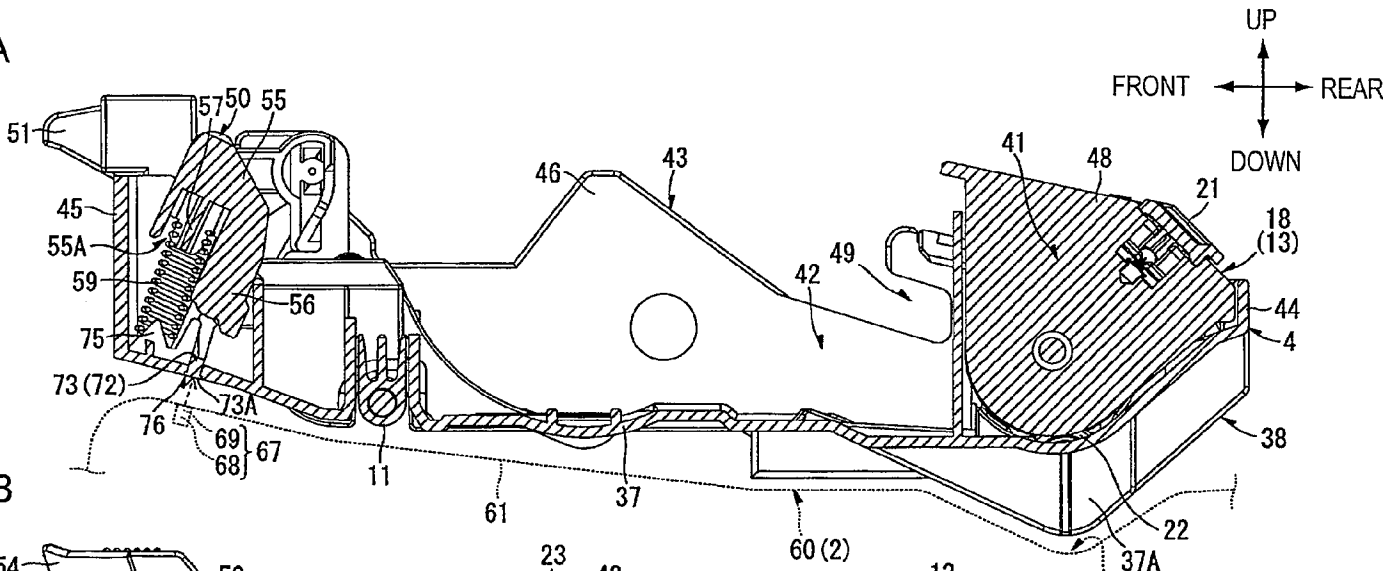
FIG. 10A is a cross-sectional view of a drum cartridge according to a third embodiment, in which the developing cartridge is removed from the drum cartridge, the drum cartridge including a pressing member according to the third embodiment, the pressing member being in the first position.

When the drum cartridge 18 alone is loaded in the main casing 2 without the developing cartridge 19 (i.e., the pressing member 50 is in the first position as shown in FIG. 10A), the detection unit 67 opposes the through-hole 76 from below. However, as described above, while the bottom end surface 73A opposes the light emitting section 68 from above, the bottom end surface 74A does not oppose the light receiving section 69 from above at this time (see FIG. 11E). Note that in FIG. 11E, the bottom end surface 74A and the light receiving section 69 seem to oppose each other, but in reality, the bottom end surface 74A is not actually facing the light receiving section 69.

In this case, as shown in FIG. 11B, the light emitted from the light emitting section 68 is incident on the bottom end surface 73A, goes leftward after being reflected by the upper end surface 73B, but is never received by the light receiving section 69 since the light only goes further leftward without being captured by the outgoing section 74 (in FIG. 11B, the outgoing section 74 is omitted from illustration as a matter of convenience). In other words, when the pressing member 50 is in the first position, the light is diffused and the light path 70 is not formed. Even if the light reaches the outgoing section 74, the light receiving section 69 never receives the light since the bottom end surface 74A is not in opposition to the light receiving section 69.

Figure 10B:
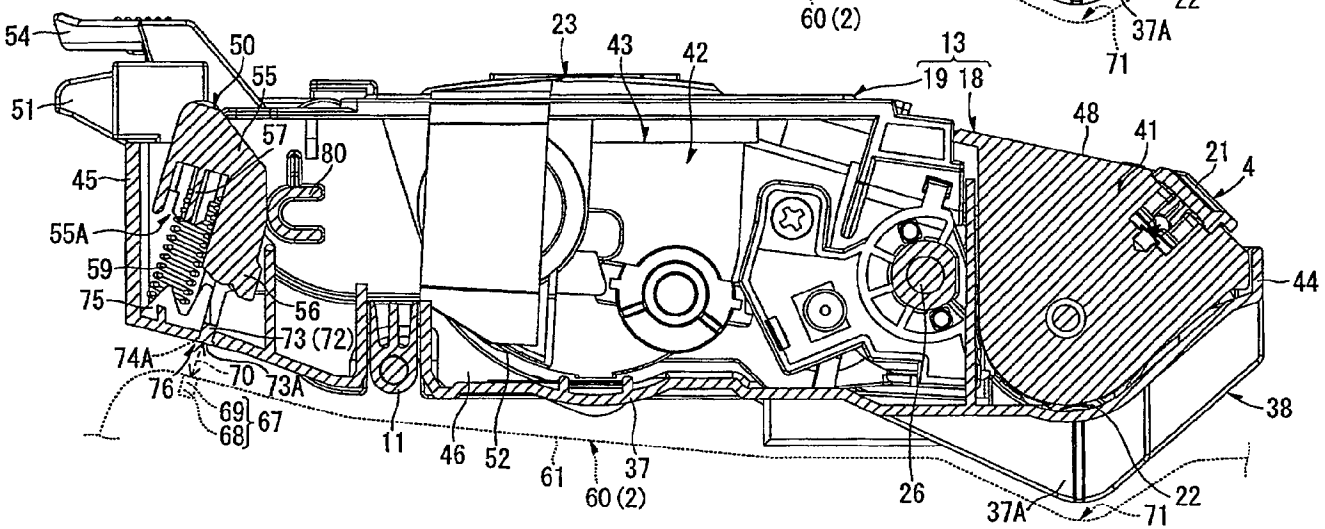
FIG. 10B is a cross-sectional view of the drum cartridge according to the third embodiment, in which the developing cartridge is mounted on the drum cartridge, the pressing member being in the second position.
Figure 12A:
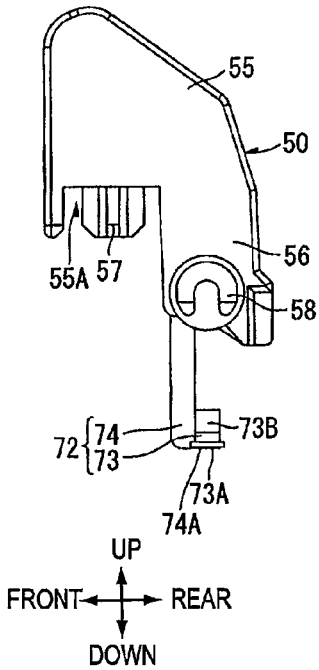
FIG. 12A is a right side view of the pressing member and a light path forming member according to the third embodiment, in which the pressing member is in the second position.
Figure 12B:
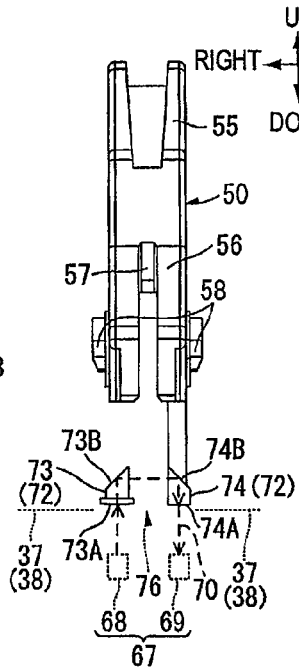
FIG. 12B is a rear view of the pressing member and the light path forming member shown in FIG. 12A.
Figure 12C:
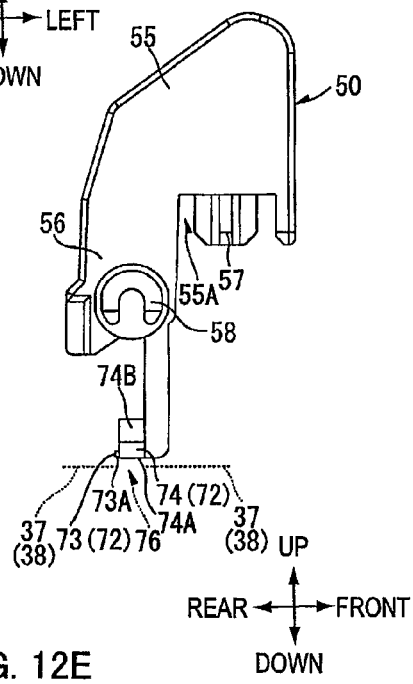
FIG. 12C is a left side view of the pressing member and the light path forming member shown in FIG. 12A.
Figure 12D:
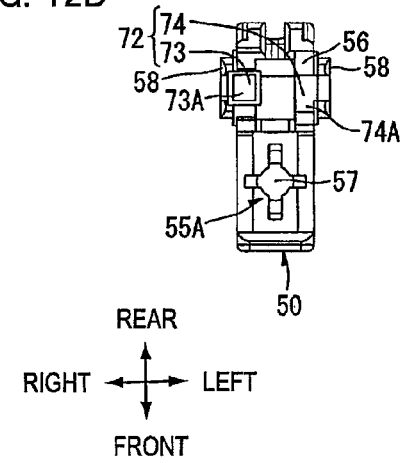
FIG. 12D is a bottom view of the pressing member and the light path forming member shown in FIG. 12A.
Figure 12E:
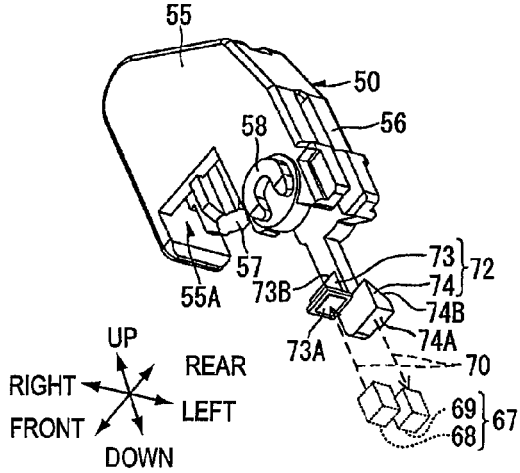
FIG. 12E is a perspective view of the pressing member and the light path forming member shown in FIG. 12A when viewed from below and rightward.

On the other hand, if the pressing member 50 is in the second position as shown in FIG. 10B, the outgoing section 74 is coincident with the incoming section 73 in the width direction. More specifically, as shown in FIGS. 12B, 12D and 12E, the upper end surface 73B of the incoming section 73 and the upper end surface 74B of the outgoing section 74 are aligned with each other in the width direction. At this time, the bottom end surface 73A and the bottom end surface 74A are both made visible from the through-hole 76, as shown in FIG. 12B.

When the complete process unit 13 (the drum cartridge 18 on which the developing cartridge 19 is mounted) is loaded in the main casing 2, the pressing member 50 is in the second position. At this time, the detection unit 67 opposes the through-hole 76 from below. In other words, the bottom end surface 73A opposes the light emitting section 68 from above, while the bottom end surface 74A opposes the light receiving section 69 from above, as shown in FIG. 12B.

In this state, when the light emitted from the light emitting section 68 is incident on the bottom end surface 73A, the light is reflected by the upper end surface 73B, goes leftward in the width direction, is reflected by the upper end surface 74B, goes downward to the bottom end surface 74A, is emitted from the bottom end surface 74A and is finally received at the light receiving section 69, as indicated by a broken arrow in FIG. 12B. As described, the upper end surface 73B and the upper end surface 74B are aligned in the width direction, meaning that the upper end surface 73B and the upper end surface 74B are aligned in a direction along which the light travels. With such a simple configuration, the light path 70 can be formed reliably (also see FIG. 12E).

When the light path 70 is formed, the detection unit 67 detects that the pressing member 50 is in the second position, as in the first embodiment.

Next, a fourth embodiment will be described with reference to FIGS. 13A through 15.

Contrary to the first to third embodiments in which the detection unit 67 detects that the pressing member 50 is in the second position when the light receiving section 69 receives the light (i.e., when the light path 70 is formed), according to the fourth embodiment, the detection unit 67 detects that the pressing member 50 is in the second position when the light path 70 from the light emitting section 68 to the light receiving section 69 is blocked.

Figure 14:
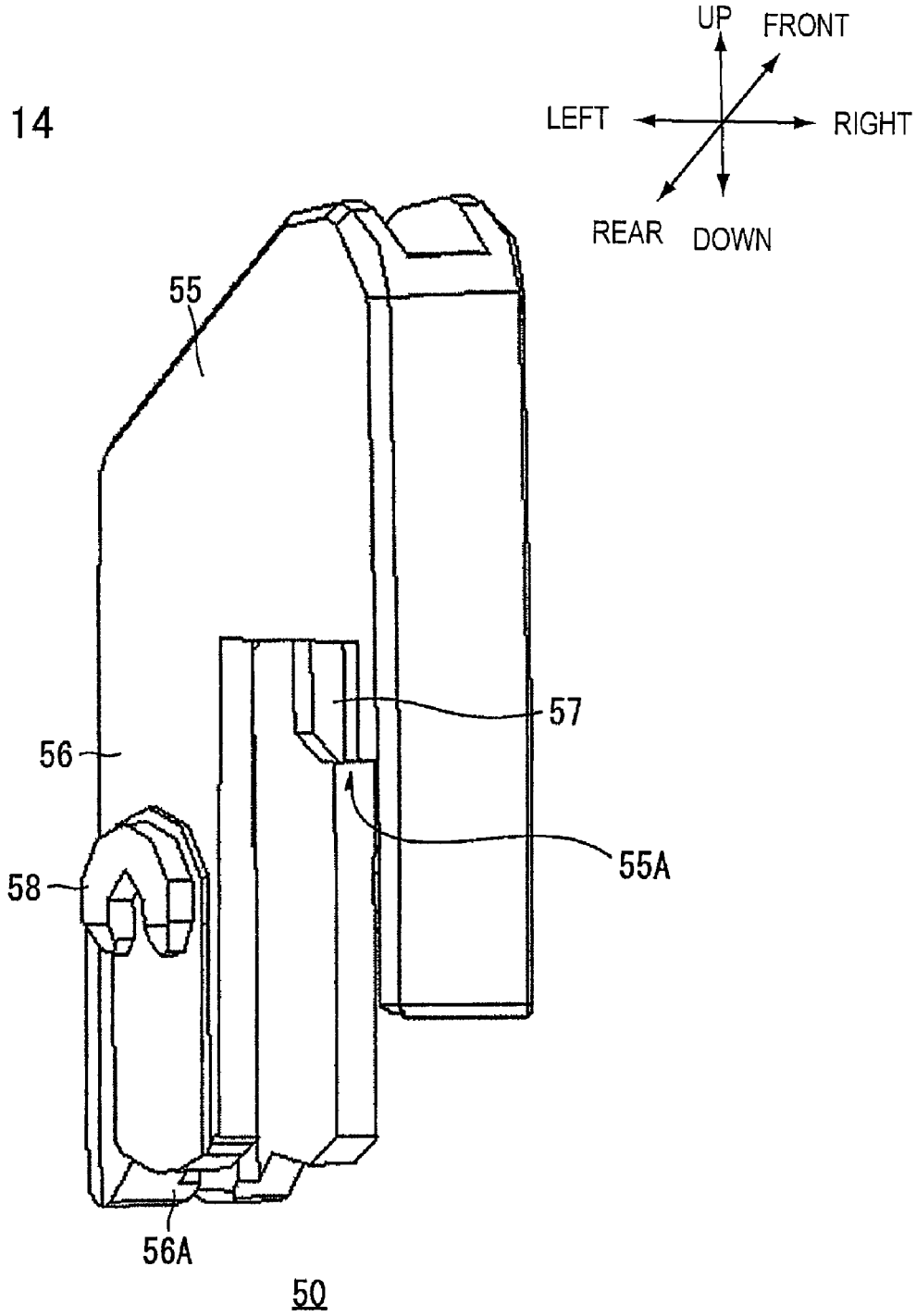
FIG. 14 is a perspective view of the pressing member according to the fourth embodiment when viewed from leftward.

In the fourth embodiment, the pressing member 50 is provided with neither of the incoming section 73 and the outgoing section 74 (see FIG. 14). In the detection unit 67 according to the fourth embodiment, when the process unit 13 is unloaded from the main casing 2, the light emitted from the light emitting section 68 is directly received by the light receiving section 69, forming the light path 70 therebetween.

Figure 15:
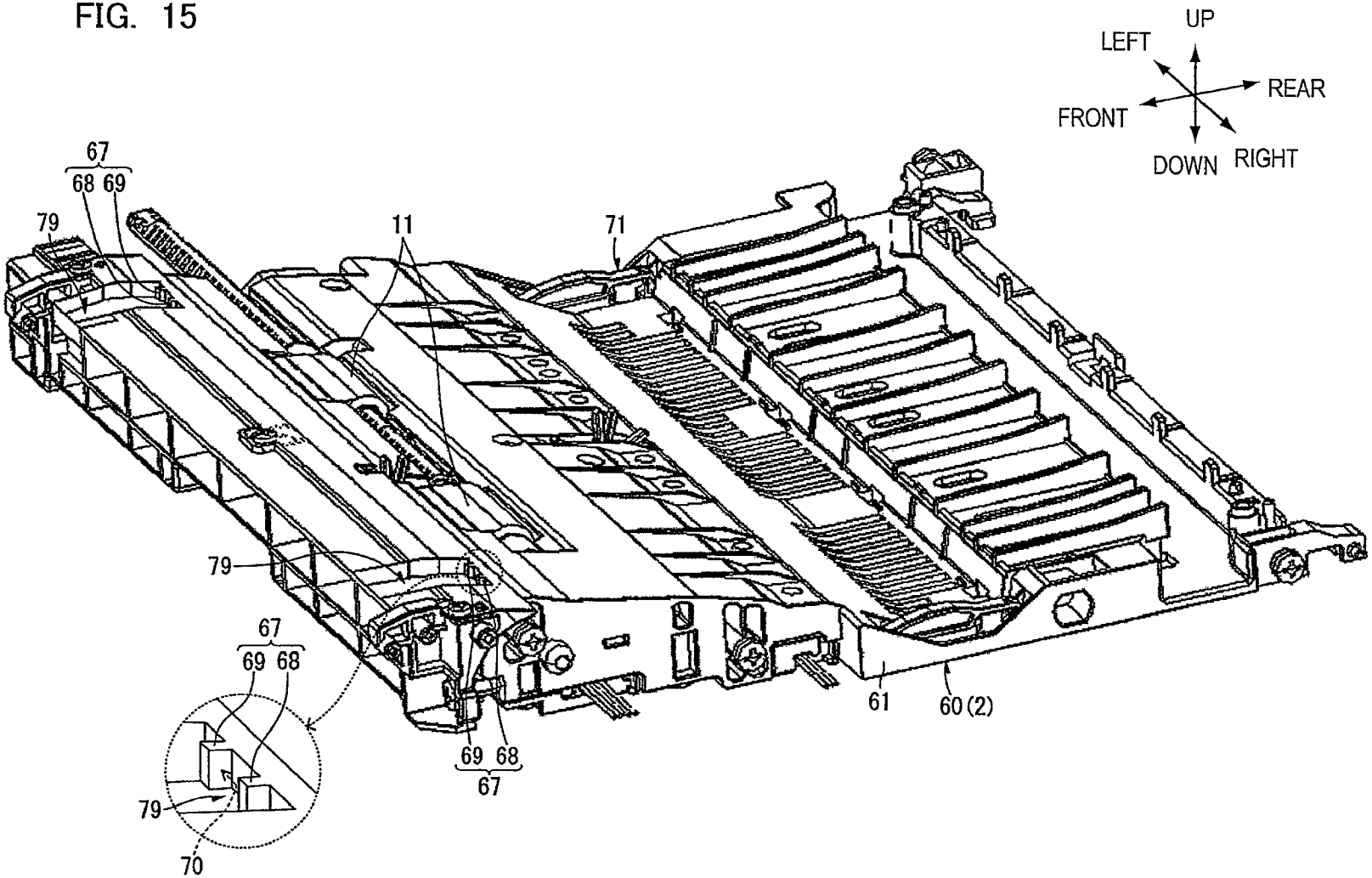
FIG. 15 is a perspective view of the feed unit provided within the printer according to the fourth embodiment, the feeding unit including a detection unit according to the fourth embodiment.

More specifically, referring to FIG. 15, two depressions 79 are formed on the upper surface of the front end portion of the unit frame 61 at positions adjacent to widthwise ends of the upper surface in the width direction. Each depression 79 has a substantially rectangular shape when viewed from above, being elongated in the front-to-rear direction. The detection unit 67 is positioned within the depression 79. The detection units 67 oppose the through-holes 76 respectively from below when the drum cartridge 18 is placed on the feed unit 60. However, as shown in an enlarged view of a portion around the detection unit 67 which is enclosed by a dotted circle in FIG. 15, the light emitting section 68 emits light leftward in the width direction, which is received by the light receiving section 69. That is, the light path 70 of the fourth embodiment is formed in the width direction, not in the up-to-down direction, as indicated by a dotted arrow in the enclosed dotted circle in FIG. 15.

Figures 13A, 13B:
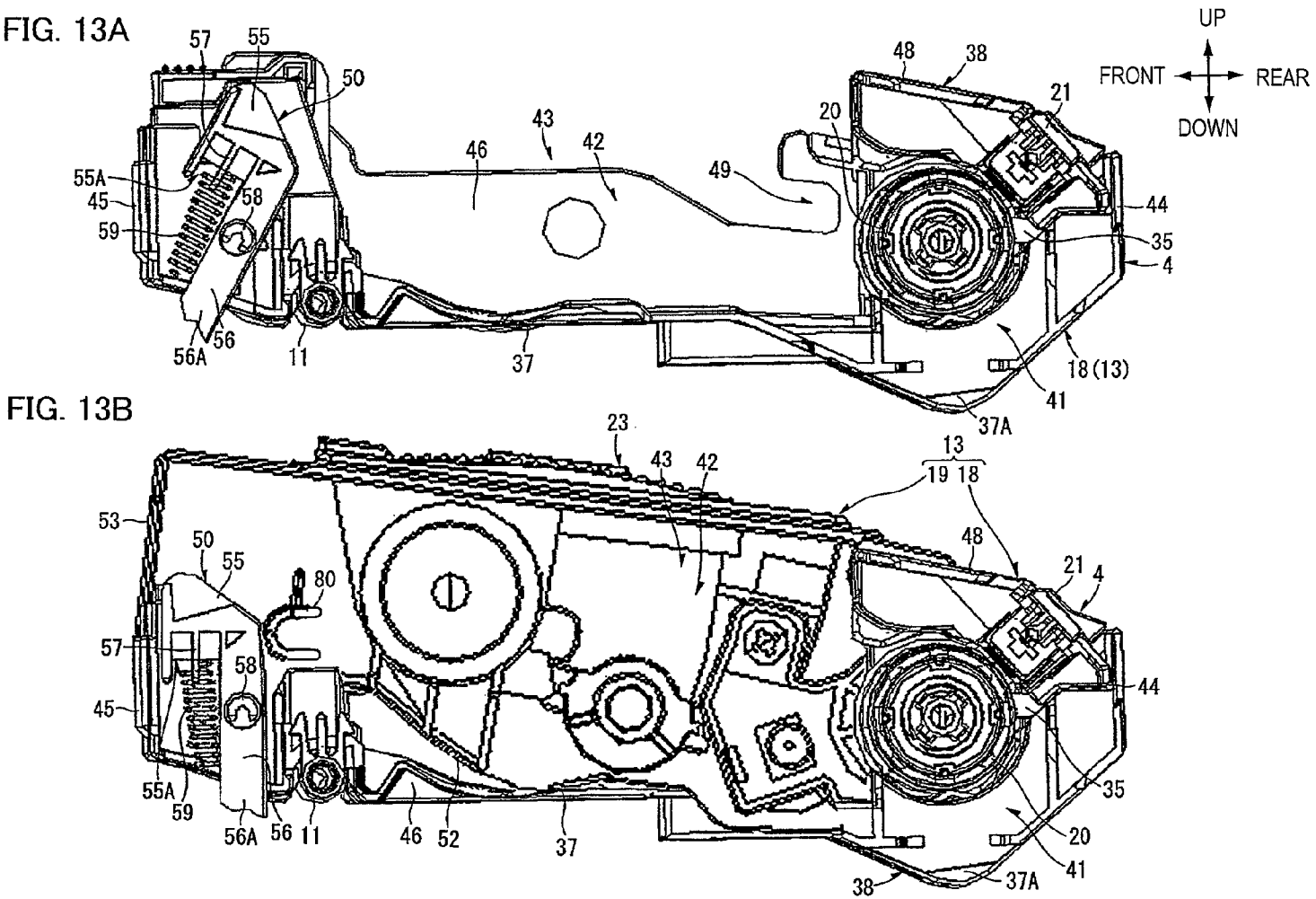
FIG. 13A is a cross-sectional view of a drum cartridge according to a fourth embodiment, in which the developing cartridge is removed from the drum cartridge, the drum cartridge including a pressing member according to the fourth embodiment, the pressing member being in the first position.
FIG. 13B is a cross-sectional view of the drum cartridge according to the fourth embodiment, in which the developing cartridge is mounted on the drum cartridge, the pressing member being in the second position.

As shown in FIGS. 13A and 13B, the extending section 56 of the fourth embodiment is formed with a bottom end portion 56A that penetrates the bottom wall 37 and is therefore always exposed outside of the bottom wall 37 of the drum casing 38. When the pressing member 50 is in the second position (see FIG. 13B), the bottom end portion 56A is positioned rearward relative to that in the first position (see FIG. 13A). In the pressing member 50, at least the bottom end portion 56A is formed of a nontransparent material.

When the drum cartridge 18 is loaded in the main casing 2, each pressing member 50 (more specifically, the bottom end portion 56A of the extending sections 56) is coupled to the corresponding depression 79 from the front and is received by the depression 79. At this time, if the drum cartridge 18 alone is loaded in the main casing 2, the pressing member 50 comes to the first position (see FIG. 13A) and therefore the bottom end portion 56A is located at a position forward of the light path 70 formed between the light emitting section 68 and the light receiving section 69 and thus in separation from the light path 70. Accordingly, the light path 70 is continued to be maintained without being blocked by the bottom end portion 56A.

When the drum cartridge 18 is loaded in the main casing 2 with the developing cartridge 19 being mounted thereon, the pressing member 50 is in the second position. The bottom end portion 56A is therefore located at a position interposed between the light emitting section 68 and the light receiving section 69 in the widthwise direction. Hence, the light path 70 is blocked by the bottom end portion 56A.

In this way, when the light from the light emitting section 68 to the light receiving section 69 is blocked by the bottom end portion 56A, the detection unit 67 detects that the pressing member 50 is in the second position. When the pressing member 50 is in the second position, nothing but the pressing member 50 itself can block the light path 70. Therefore, the detection unit 67 can reliably detect that the pressing member 50 is in the second position.

Further, the main casing 2 (to be precise, the feed unit 60) is formed with the depressions 79 for receiving the pressing members 50 of the drum cartridge 18 that has been loaded in the main casing 2. Hence, the drum cartridge 18 can be loaded in or unloaded from the main casing 2 without causing any interference between the pressing member 50 and the main casing 2. Further, the detection unit 67 is provided on each depression 79, enabling the detection unit 67 to detect the position of the pressing member 50 without being affected by anything that surrounds the detection unit 67.

While the invention has been described in detail with reference to the embodiments thereof, it would be apparent to those skilled in the art that various changes and modifications may be made therein without departing from the spirit of the invention.

For example, in the above described embodiments, the present invention has been applied to the process unit 13 (the drum cartridge 18 and the developing cartridge 19). However, the present invention may also encompass other combinations of cartridges, such as a toner cartridge that accommodates toner therein and a developing unit that includes a developing roller and a supply roller for supplying toner to the developing roller.

Further, in the first through fourth embodiments two pressing members 50 are provided on the drum cartridge 18. The detection unit 67 may be configured to detect the position of either one of the pressing members 50, or the positions of both pressing members 50.

Further, the printer 1 according to the first to fourth embodiments is provided with the informing unit 91 for informing the user of errors. However, the printer 1 may not have the informing unit 91. In the latter case, an informing unit may be provided on a computer to which the printer 1 is connected. Upon detection of an error, the printer 1 outputs a signal, to the computer, indicating occurrence of the error. In response to such error signal, the computer informs the user of the error with a prescribed method (an error display, for example).

In the above-described embodiments, the present invention is applied to a monochrome printer. However, the present invention may also be applicable to a color printer. Further, although the photosensitive drum 20 is exposed to light by the laser beam in the above-described embodiments, LED arrays may be used instead to expose the photosensitive drum 20 to light.

What is claimed is:

1. An image forming device comprising:

a main casing;

a cartridge accommodating portion configured to detachably accommodate a first cartridge and a second cartridge detachably combinable with the first cartridge, the first cartridge being provided with a pressing member movable between a first position and a second position, the pressing member being in the first position when the second cartridge is removed from the first cartridge, the pressing member being in the second position when the second cartridge is combined with the first cartridge, a detection unit provided on the main casing and configured to perform non-contact position detection of the pressing member; and a processor configured to not start image forming operations until the detection unit detects that the pressing member is in the second position.

2. The image forming device according to claim 1, wherein the detection unit includes a light emitting section configured to emit light and a light receiving section configured to receive the emitted light, the detection unit being configured to detect the position of the pressing member based on whether the light receiving section receives the light.

3. The image forming device according to claim 2, wherein the first cartridge further includes a light path forming member configured to receive the light emitted from the light emitting section and to direct the received light toward the light receiving section to form a light path from the light emitting section to the light receiving section, the light path forming member configured to form the light path when the pressing member is in the second position, wherein the detection unit is configured to detect that the pressing member is in the second position when the light receiving section receives the light emitted from the light emitting section.

4. The image forming device according to claim 1, wherein the first cartridge is a drum cartridge including a photosensitive drum, and the second cartridge is a developing cartridge including a developing roller that is urged against the photosensitive drum by the pressing member when the photosensitive drum and the developing cartridge are combined.

5. The image forming device according to claim 3, wherein the light path forming member is provided on the pressing member.

6. The image forming device according to claim 5, wherein the light path forming member and the pressing member are integrally formed.

7. The image forming device according to claim 3, wherein the light path forming member is formed of a transparent material.

8. The image forming device according to claim 3, wherein the light path forming member is provided on the first cartridge and the pressing member.

9. The image forming device according to claim 8, wherein the light path forming member includes a first member and a second member, the first member being provided on the first cartridge, the second member being provided on the pressing member, the first member being configured to form the light path when the pressing member is in the second position, the second member being configured to block formation of the light path when the pressing member is in the first position.

10. The image forming device according to claim 8, wherein the light path forming member includes a first member and a second member, the first member being provided on the first cartridge, the second member being provided on the pressing member, the second member being configured to be aligned with the first member in a direction in which the light travels when the pressing member is in the second position, the light path being formed when the first member and the second member are aligned in the direction.

11. The image forming device according to claim 2, wherein the pressing member is configured to block the light emitted from the light emitting section from being received by the light receiving section in the second position, the detection unit detecting that the pressing member is in the second position when the light emitted from the light emitting section is blocked.

12. The image forming device according to claim 11, wherein the pressing member protrudes from the first cartridge.

13. The image forming device according to claim 1, wherein the main casing is formed with a recess within which the detection unit is disposed.

14. The image forming device according to claim 13, wherein the pressing member protrudes from the first cartridge and the recess is configured to receive the protruding pressing member when the first cartridge is loaded in the main casing.

15. The image forming device according to claim 2, further comprising an informing unit configured to inform a user that either one of the first cartridge and the second cartridge has not been loaded in the main casing when the detection unit detects that the light receiving section does not receive the light.

16. The image forming device according to claim 1, wherein the determination unit is further configured to output, to a computer connectable to the image forming device, signals indicative of loading status of the first cartridge and the second cartridge, the computer including an informing unit configured to inform a user of the loading status of the first cartridge and the second cartridge in response to the signals outputted from the determination unit.

17. A drum cartridge detachably loadable in an image forming device, comprising:

a photosensitive drum on which an electrostatic latent image is formable;

a casing configured to rotatably support the photosensitive drum, the casing further configured to detachably accommodate a developing cartridge including a developing roller, the developing roller configured to supply developer to the photosensitive drum when the developing cartridge is mounted on the casing;

a pressing member provided on the casing, the pressing member being movable between a first position and a second position, the pressing member being in the first position when the developing cartridge is removed from the casing, the pressing member being in the second position when the developing cartridge is mounted on the casing, the pressing member configured to press the developing roller against the photosensitive drum in the second position; and an incident surface, an output surface and a guide portion, the guide portion configured to direct light incident on the incident surface toward the output surface, the output surface configured to output the light coming from the incident surface to an outside of the casing when the pressing member is in the second position.

18. The drum cartridge according to claim 17, wherein the light path forming member is provided on the pressing member.

19. The drum cartridge according to claim 17, wherein the pressing member including a light blocking section and the light path forming member is provided on the casing, the light blocking portion being configured to block the light outputted from the output surface when the pressing member is in the first position and to not block the light when the pressing member is in the second position.

20. The drum cartridge according to claim 17, wherein the incident surface is provided on the casing and the output surface is provided on the pressing member, the output surface being configured to be aligned with the incident surface in a direction in which the light travels when the pressing member is in the second position.

21. A drum cartridge detachably loadable in an image forming device, comprising:

a photosensitive drum on which an electrostatic latent image is formable;

a casing configured to rotatably support the photosensitive drum, the casing being further configured to detachably accommodate a developing cartridge including a developing roller, the developing roller configured to supply developer to the photosensitive drum when the developing cartridge is mounted on the casing; and a pressing member provided on the casing, the pressing member being movable between a first position and a second position, the pressing member being in the first position when the developing cartridge is removed from the casing, the pressing member being in the second position when the developing cartridge is mounted on the casing, the pressing member configured to press the developing roller against the photosensitive drum in the second position, the pressing member including a light blocking portion configured to block light when the pressing member is in the second position.

22. The drum cartridge according to claim 21, wherein the light blocking portion protrudes from the casing.

23. A pressing member movably supported to a drum cartridge including a photosensitive drum, the drum cartridge being capable of detachably accommodating therein a developing cartridge including a developing roller, the pressing member configured to press the developing roller against the photosensitive drum, the pressing member comprising a light path forming member including an incident surface, an output surface and a guide portion, the guide portion configured to direct light incident on the incident surface toward the output surface, the output surface configured to output the light coming from the incident surface to outside of the drum cartridge when the developing cartridge is mounted on the drum cartridge.

* * * * *